US007249903B2

(12) United States Patent
Shaw, III

(10) Patent No.: US 7,249,903 B2
(45) Date of Patent: Jul. 31, 2007

(54) ASSEMBLY FOR FEEDING A CONTINUOUS ROLL OF WEB MATERIAL TO A SHEET FED PRINTING DEVICE

(75) Inventor: James E. Shaw, III, Plainfield, CT (US)

(73) Assignee: Astro-Med, Inc., West Warwick, RI (US)

( * ) Notice: Subject to any disclaimer, the term of this patent is extended or adjusted under 35 U.S.C. 154(b) by 248 days.

(21) Appl. No.: 10/998,460

(22) Filed: Nov. 29, 2004

(65) Prior Publication Data

US 2006/0115313 A1 Jun. 1, 2006

(51) Int. Cl.
*B41J 11/00* (2006.01)

(52) U.S. Cl. ..... 400/621; 400/611

(58) Field of Classification Search ..... 400/621, 400/611, 703, 706, 708; 399/16–21
See application file for complete search history.

(56) References Cited

U.S. PATENT DOCUMENTS

| | | | | |
|---|---|---|---|---|
| 1,959,332 A | | 5/1934 | Bowles et al. | 242/107 |
| 4,013,006 A | | 3/1977 | Burrell et al. | 101/227 |
| 4,221,481 A | | 9/1980 | Savarick | 355/72 |
| 4,893,763 A | | 1/1990 | Wales et al. | 242/58.6 |
| 5,099,290 A | * | 3/1992 | Yokota | 358/1.12 |
| 5,720,447 A | | 2/1998 | Brechko | 242/563.1 |
| 5,743,663 A | | 4/1998 | Imai | 400/120.04 |
| 5,751,298 A | | 5/1998 | Crowley | 346/136 |
| 5,768,675 A | | 6/1998 | Estabrooks | 399/385 |
| 5,818,470 A | | 10/1998 | Crowley | 346/136 |
| 5,927,876 A | | 7/1999 | Fox | 400/579 |
| 5,957,827 A | | 9/1999 | Barrus et al. | 493/413 |
| 6,039,479 A | | 3/2000 | Hill et al. | 400/621 |
| 6,068,418 A | | 5/2000 | Fox | 400/579 |
| 6,084,624 A | | 7/2000 | Yamakawa | 347/175 |
| 6,183,406 B1 | | 2/2001 | Barrus et al. | 493/320 |
| 6,189,991 B1 | | 2/2001 | Wen et al. | 347/13 |
| 6,390,584 B1 | | 5/2002 | Larson et al. | 347/16 |
| 6,520,080 B1 | | 2/2003 | Fried | 101/227 |
| 6,633,740 B2 | | 10/2003 | Estabrooks | 399/384 |

(Continued)

FOREIGN PATENT DOCUMENTS

| | | |
|---|---|---|
| JP | 8207176 | 8/1996 |

*Primary Examiner*—Minh Chau
(74) *Attorney, Agent, or Firm*—Barlow, Josephs & Holmes, Ltd.

(57) ABSTRACT

An assembly for feeding, printing, and cutting a continuous web of material is provided. The web is fed from a roll supported in a roll feeding unit to a printer unit. The web can carry distinct image-receiving media items or can be a plain continuous web material. The assembly is particularly useful for feeding a web carrying pressure-sensitive adhesive labels to a laser printer. The printer produces printed images on each label as the web is fed through the printer. Then, the web can be cut to produce a finished roll of printed labels ready for application. The assembly includes a roll feeding unit, a printer, a controller for the roll feeding unit, and a controller for the printer which communicate with each other. The controller is responsive to sensors and signals received from the printer controller, and the printer controller is responsive to the sensors and signals received from the roll feeding unit controller. In this manner, the feeding, printing, and cutting of the web are controlled precisely.

19 Claims, 17 Drawing Sheets

U.S. PATENT DOCUMENTS

2003/0156883 A1 8/2003 Kobayashi et al. ..... 400/621
2003/0167944 A1 9/2003 McKillip ..... 101/226
2004/0026024 A1 2/2004 Nakasaka et al. ..... 156/250

* cited by examiner

ASSEMBLY FOR FEEDING A CONTINUOUS ROLL OF WEB MATERIAL TO A SHEET FED PRINTING DEVICE

BACKGROUND OF THE INVENTION

The present invention relates generally to a roll feed unit for feeding a continuous web of material from a roll to a sheet fed printing device such as a conventional sheet fed laser printer. In combination, the roll feeding unit and printing device provide an integrated assembly that is used to feed, print, and cut the continuous web material. The roll feeding unit can be used to feed a continuous web of print media such as, for example, a web of banner paper or a web of adhesive-backed paper. In other instances, the roll feeding unit can be used to feed a continuous web of carrier material carrying distinct image-receiving media items such as, for example, pressure-sensitive adhesive labels. In all cases, the printer produces a toner image on the web as it is fed through the printer. At the end of the printing operation, the web is cut to produce a finished roll of printed media or a finished roll of printed labels that are ready for application to packages, containers, and other articles.

One of the important concepts of the invention is to provide a roll feed assembly which functions to retrofit a conventional sheet fed laser printer so that it can operate as a continuous feed printer. A conventional laser printer includes an image transfer assembly, which transfers a toner image from an imaging belt or drum to a single sheet of paper, as the paper is fed through the printer. The feed rate of the paper is synchronized with the print drive of the printer so that the paper is fed to the imaging belt or drum at the time when the image is ready to be printed on the paper. The image is transferred to the paper, and a fixing unit in the printer fixes the image on the paper. This results in a generally high-quality printed image being produced on the paper. However, one drawback to conventional laser printers is that they are generally designed to accept only stacked, pre-cut sheets of paper. It would be desirable to provide a system that could feed a continuous roll of paper, rather than individual sheets, to a conventional laser printer. Such a system would be more efficient and economically advantageous in many applications. For example, the system could be used for on-demand printing of individual labels that are carried on a continuous roll of paper or other web material.

The industry has previously attempted to address the feeding of a continuous roll of paper to a laser printer in a number of ways. For example, Estabrooks, U.S. Pat. No. 5,768,675 ("Estabrooks '675") discloses an on-demand electrophotographic printer for printing an image on a continuous web being fed from a roll. The Estabrooks '675 printer includes an internal feeding and cutting mechanism integrated into the printing device itself for feeding a continuous roll of media through the print engine.

In one embodiment of Estabrooks '675, the front edge of the paper web is sensed by a detector. Then, the speed of the image carrier drum in the printer is accelerated. The paper feed stepper motor is synchronized so that it accelerates to the same speed as the drum, and the paper is fed to the point where the image can be precisely transferred to the paper. At the end of the printout, the drum stops rotating, while the paper feed motor slows the web speed and stops the web at a cutter for cutting the printout. A controller then reverses the paper feed motor, returning the cut edge of the paper web to the start position, where it awaits the start of the next print cycle. Thus, Estabrooks '675 solves the problem of printing on a continuous paper web with an integrated roll feeding assembly located within the printer. There is no external roll feeding unit for feeding the paper web to the printer. Furthermore, in Estabrooks '675, the paper web is cut after each printout by a cutting mechanism within the printer. Then, the front edge of the paper, which has just been cut, is retracted to a start position in front of the image carrier drum within the printer, and a new printing cycle begins.

Estabrooks, U.S. Pat. No. 5,633,740 ("Estabrooks '740") also discloses an on-demand media web electrophotographic printer containing an integrated feeding and cutting assembly. This apparatus also can be used for printing tickets, tags, barcodes, and labels on a paper web. The apparatus includes a system for monitoring and controlling the web feeding, registration, and cutting of the web by utilizing a sensor system. The sensor system includes a web buckle sensor that senses whether or not a web buckle has been formed prior to each feeding and cutting of the web. A central processor commands the feed roll unit to advance the leading edge of the web so that the edge is detected and stopped at a registration roll nip. With the leading edge of the media web positioned correctly, the processor feeds the edge of the web against an upper registration roll and web guide to form a web buckle. According to Estabrooks '740, the web buckle is necessary to allow time for a clean cut of the web to occur, but its length is small enough to avoid feeding jams. Thus, Estabrooks '740 solves the problem of printing on a continuous roll of paper with an integrated roll feeding assembly located within a printer.

Although the roll feeding systems described in the foregoing Estabrooks '675 and '740 patents may be effective in some instances, it would be desirable to have a new system which uses an external roll feeding unit for feeding a continuous roll of web material to a printer. The external roll feeding unit provides several advantages in terms of cost and ease of use. For example, by providing an external roll feeding unit that serves to retrofit an existing laser printing device, the costs of redesigning the basic printing unit are saved, and the efficiencies and low costs of conventional laser printing devices are retained. Further, it is easier to load and reload the roll of web material, and to service the roll feeding mechanisms in an external roll feeding unit versus an internal roll feed that is housed within the printing unit.

The present invention provides such a new feeding, printing, and cutting system. The web roll feeding apparatus of the present invention is an external unit that supports and feeds the web to the printer. The assembly of this invention includes a roll feeding unit, a cutter, a printer unit, a roll feeding unit controller, a printer controller, and various sensors for synchronizing the feeding, printing, and cutting of the web. These and other objects, features, and advantages of this invention are evident from the following description and attached figures.

SUMMARY OF THE INVENTION

The present invention provides a roll feeding unit for feeding a continuous web of material from a roll to a printer unit. The roll feeding unit and printer unit make up an integrated assembly for feeding, printing, and cutting a continuous web of material. The web is fed from a roll supported in the roll feeding unit to the printer unit. The roll feeding unit, as described in the context of the preferred embodiments, is particularly suitable for feeding a web carrying pressure-sensitive adhesive labels to a laser printer. Printed toner images are generated on each of the labels as the web is fed through the printer. Then, the web is cut to produce a finished roll of printed labels that are ready to be applied to packages and other items. While the present invention recognizes that the one of the preferred forms of media is a carrier web carrying die cut label media, it should be understood that the assembly can be used for feeding and printing any suitable image-receiving media which is embodied in a continuous web. For example, the continuous web of print media can be paper, foil, textiles, transparent plastic films, opaque plastic media, cardstock, or perforated adhesive backed paper materials. The listing of media herein is intended to be representative of the types of media intended for use, but this listing is not intended to be limiting.

The roll feeding unit includes: (i) a frame having a first end portion with an elongated support arm for supporting a core that holds the roll of web material; (ii) a feeding station located at a second end portion of the frame, the feeding station including upper and lower feed rollers for feeding the web therebetween; (iii) a cutter device for cutting the web; and (iv) multiple sensors for sensing the position of the web as the web is fed to the printer.

The assembly of this invention further includes a printer unit that includes: (i) at least one toner transfer station for producing a toner image on the web as the web is advanced through the at least one toner station; and (ii) multiple sensors for sensing the position of the web as it is advanced through the printer.

The assembly also includes a roll feeding unit controller for controlling the operations of the roll feeding unit. The printer includes its own printer controller for controlling the operations of the printer. The roll feed controller and the printer controller are provided with a communications path so that the roll feeding unit controller can be responsive to the sensors and signals received from the printer controller, vice versa, so that the printer controller can be responsive to the sensors and signals received from the roll feeding unit controller. By this two-way communication mechanism, the feeding, printing, and cutting of the web are controlled precisely and a given area of the web is advanced to a toner transfer station in the printer at the exact time when that toner transfer station is ready to print the image on that area of the web.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description taken in connection with the accompanying drawings in which:

DETAILED DESCRIPTION OF THE PREFERRED EMBODIMENTS

Figure 1:
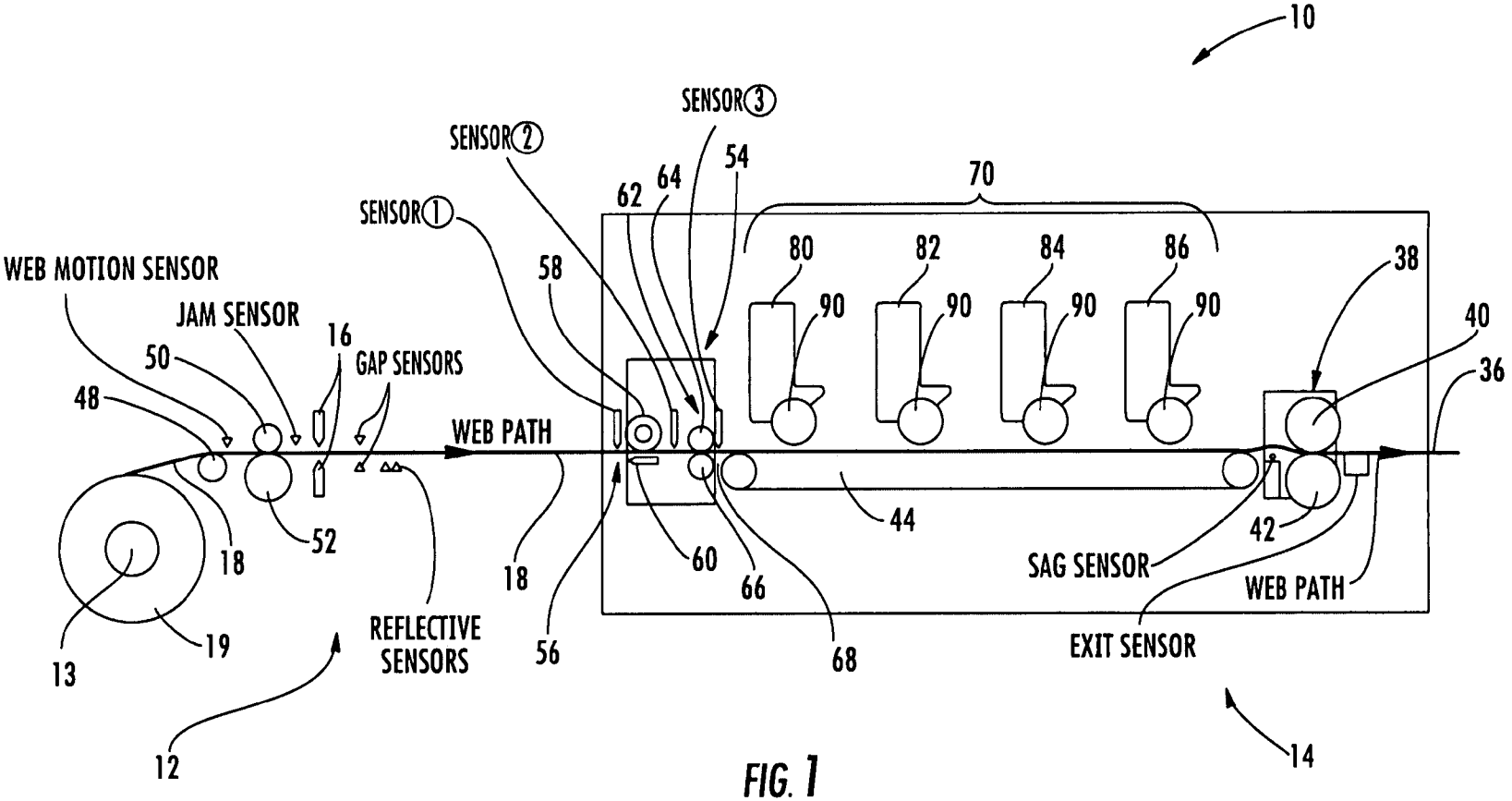
FIG. 1 is a schematic diagram showing the feeding, printing, and cutting assembly of the invention including the roll feeding unit and printer unit.

Referring to FIG. 1, the feeding, printing, and cutting assembly (10) of this invention is generally shown. The assembly (10) includes an external roll feeding unit generally indicated at (12) and a printer unit generally indicated at (14). The roll feeding unit (12) includes a cutter subassembly generally indicated at (16). Although there are many suitable printers can be used with the feeding, printing, and cutting system of this invention, this system is particularly adaptable for use with electrophotographic printers which use a toner transfer process to produce a printed image on an imaging medium. For example, OKI Series 7300 Laser Printers may be used as the printer unit (14) in accordance with this invention. More preferably, an OKI Laser Printer Model No. C7363, which has been modified so that it can operate in combination with the external roll feeding unit (12) per this invention, is used as the printer (14).

Toner Transfer Process

Before proceeding with a description of the roll feeding unit, a brief description of the electrophotographic printing process will provide the proper context for further description of the invention.

The toner transfer process by which the printer (14) produces the printed image on the labels (20) is generally known in the art. The process generally involves using a laser printhead or other optical imaging element carrying the print data to scan a rotating photosensitive drum and create a latent image (not visible) on the surface of the drum. The laser printhead directs light at the drum to selectively charge or discharge imaging areas of the drum. In an image developing step, a toner development roller changes the latent image on the surface of the drum into a visible image by selectively depositing charged toner particles on the imaging areas of the drum.

For example, the toner particles may be negatively charged so that they are attracted to the exposed, more positively charged areas of the photosensitive drum, and repelled from the non-exposed, negatively charged areas of the drum. The photosensitive drum is typically located opposite a transfer charge roller. As the web (18) passes between the drum and transfer charge roller, a positive charge can be applied to the backside of the web (18) by the transfer charge roller. Now, the negatively charged toner particles, which are located on the imaging surface areas of the drum, will be attracted to the positively charged web (18).

As shown in FIG. 1, the web (18) carrying the labels (20) can be transported by a conveyor belt (44) to four toner transfer stations (80, 82, 84, and 86) which transfer toner onto the labels. This toner transfer step produces a full-colored printed image on the labels (20). Each toner transfer station (80, 82, 84, and 86) includes a different colored toner that can be transferred onto the labels (20) to produce the desired colored print. The four preferred toner colors used to produce a full-colored image are black, yellow, magenta, and cyan.

In FIG. 1, toner transfer station (80) can be used for transferring black toner; toner transfer station (82) can be used for transferring yellow toner; toner transfer station (84) can be used for transferring magenta toner; and toner transfer station (86) can be used for transferring cyan toner. It is understood that arranging the toner transfer stations (80, 82, 84, and 86) in this sequence is for illustration purposes only and represents only one possible embodiment. There are many possible variations to arranging the toner transfer stations (80, 82, 84, and 86) in the printer (14).

Also, as shown in FIG. 1, the toner transfer stations (80, 82, 84, and 86) are arranged in a side-by-side configuration, and each toner station includes a photosensitive drum (90), toner development roller (not shown), and transfer charge roller (not shown) which are discussed above. The transfer of the toner to a given label (20) is started as the label (20) arrives at the image transfer point in a particular toner transfer station (80, 82, 84, and 86). The conveyor belt (44), which transports the web (18), is powered by the same motor used to power the photosensitive drums (90). Thus, the speed of the conveyor belt (44) can be synchronized so that a given label (20) to be printed thereon converges with the photosensitive drum (90) at the precise time when the toner image is ready to be laid down on the label (20). The toner transfer stations (80, 82, 84, and 86) are directed to print the image by the printer controller which communicates with the roll feeding unit controller as will be discussed further below.

Different colored toners may be applied precisely to the same location on a given label (20) and accurately registered with each other in order to produce a desired color. For example, a toner resin of a given color may be transferred onto the label (20) so that it overlaps and registers exactly with another toner resin to produce the intended full-color print.

This toner transfer process forms real printed images on the labels (20). The photosensitive drum (90) rotates continuously so long as it receives a signal to continue laying down toner and printing the labels (20). The web (18) is advanced by the roll feeding unit (12) and printer (14), working in precise combination with each other, so that a given label (20) to be printed thereon converges with a toner transfer station (80, 82, 84, and 86) at the proper time. In this way, a toner image is printed in precise registration onto each label (20) being carried by the web (18). The image is accurately printed onto each label (20) to provide a high quality printed product. The label (20) can be printed with any image or indicia such as, for example, letters, numbers, symbols, geometric shapes, graphics, illustrations, photographs, and the like. Then, the web (18) continues advancing to the fusing station (38), where the fusing process fixes the toner image on the label (20) in a manner as described above.

Roll Feed Unit

Figure 2:
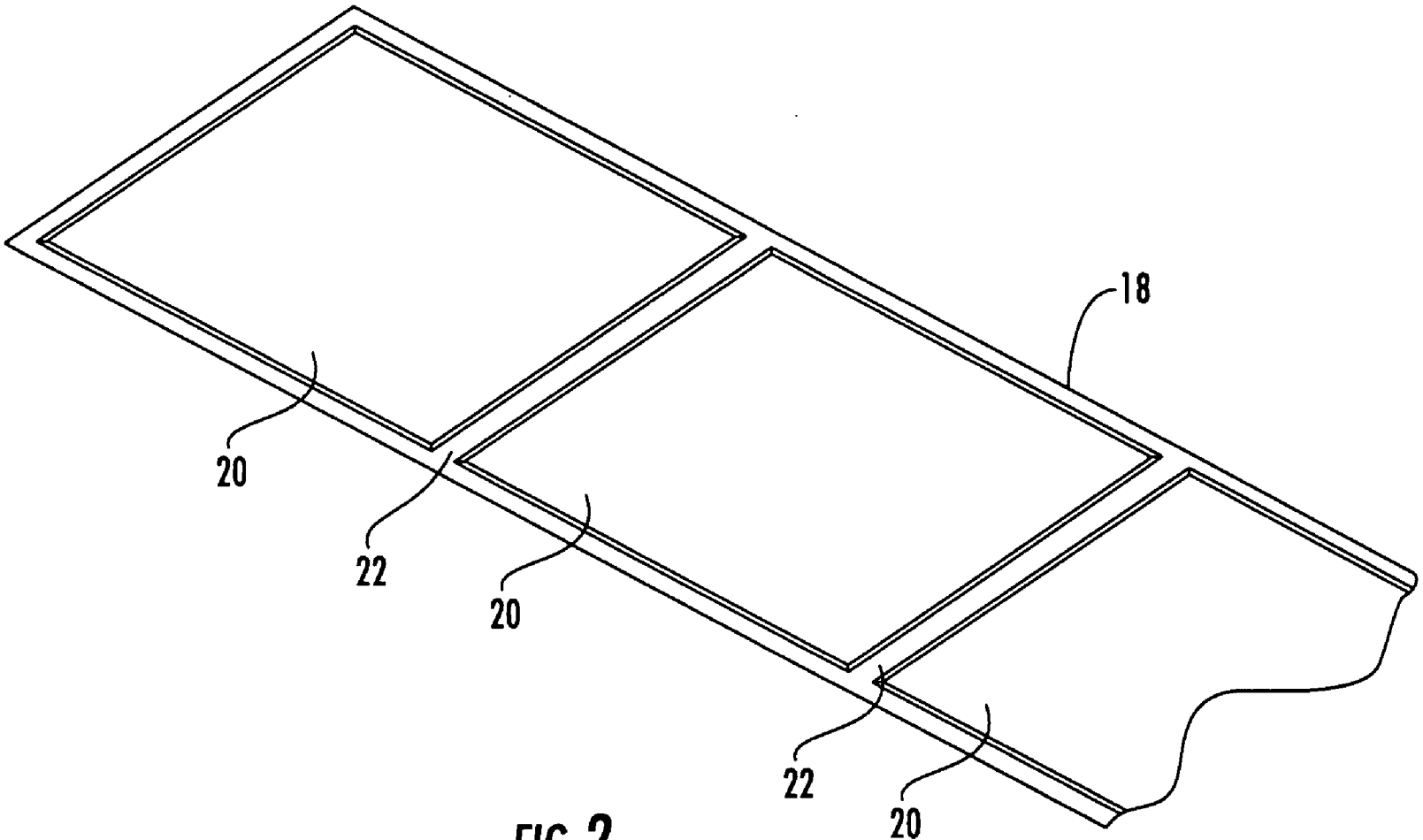
FIG. 2 is a perspective view of a continuous web material carrying pressure-sensitive adhesive labels.

The roll feeding unit (12) supports acontinuous roll (19) of web material (18) which serves as the imaging medium. The roll (19) of web material (18) is mounted on a core (13). The web (18) can be made of any suitable material that will receive a printed image. For example, suitable materials include paper, plastic films, card stock, paper board, card board, textile materials such as non-woven fabrics, metal foils, and the like. The web material (18) can have a transparent or opaque nature. As shown in FIG. 2, the continuous web (18) is illustrated as comprising a backing material carrying a set of pressure-sensitive adhesive labels (20). Each label (20) is a separate and distinct item that is spaced apart from other labels (20) on the web (18) by gaps (22) that extend along the length of the web (18). The pressure-sensitive adhesive labels (20) can be formed on the web (18) using a wide variety of techniques. For example, the labels (20) may be die-cut articles. In other embodiments, perforated labels (20) may be formed with each label (20) being defined by perforated lines. The labels (20) are spaced apart at predetermined distances along the length of the web (18), and the labels (20) may have any suitable dimensions. For example, in one embodiment, each individual label (20) typically measures 4 inches×6 inches. However, the width of the web (18) may be of any appropriate size capable of being received within the print engine. For most laser printers, the width is typically limited to 8.5 inches. However, the system of the present invention could be equally applicable to large format printers with larger media capabilities.

The feeding, printing, and cutting assembly (10) of this invention is described and illustrated herein primarily as an assembly for producing images on pressure-sensitive adhesive labels (20) which are carried by a paper web (18). However, it is understood that the assembly (10) can be used for printing any web material including paper, plastic films, card stock, paper board, card board, textile materials, and metal foils as described above. Moreover, it should be recognized that the web material (18) is not required to carry labels (20) or any other distinct image-receiving media items. Rather, the assembly (10) can be used to produce images on the plain continuous web material (18) itself. In still other embodiments, the web (18) can carry distinct image-receiving media items other than pressure-sensitive labels (20) including, for example, cards, tags, tickets, receipts, coupons, and the like.

Tension Of Feed Roll

Figure 3:
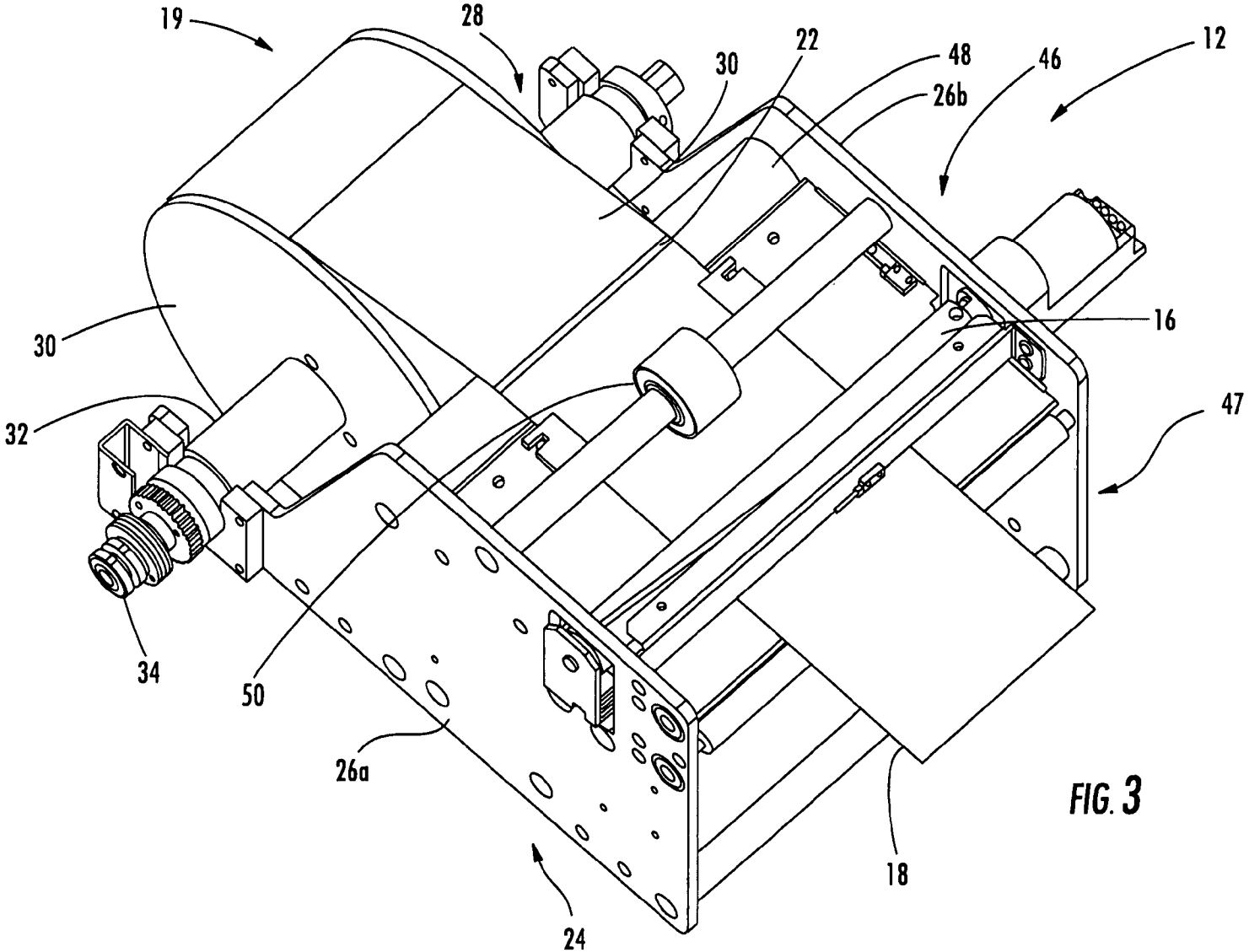
FIG. 3 is a perspective view of the roll feeding unit showing the unit supporting and feeding a continuous roll of web material.

Referring to FIG. 3, the roll feeding unit (12) includes a frame (24) having two sidewall segments (26*a*, 26*b*). One end portion (28) of the frame (24) supports a roll of web material (18). The roll (19) is wound on a core (not shown) which is supported by an elongated support arm (32). The side guides of the core are indicated at (30). The roll feeding unit (12) includes a tension control (34) which sets the tension of the web roll (19). After loading the web roll (19)

into the roll feeding unit (12), the tension of the roll (19) is initially set. The size the roll (19) can vary depending upon the size of the printing job. In the illustrated embodiment, the width of the roll (19) is slightly larger than 4 inches so as to carry the representative 4×6 inch adhesive-backed labels. In the case of a wide banner, the width of the roll (19) would typically be about 8 inches. For both adhesive-backed labels and wide banner applications, the diameter of the roll (19) is typically about 8 inches.

Referring back to the tensioning of the roll, in the exemplary embodiment for a web (18) carrying 4×6 inch adhesive-backed labels, the tension of the roll (19) is initially set at about 600 grams. It is important that the web roll (19) has a sufficient degree of back tension so that the web (18) can be "pulled in" by the printer unit (14). If the back tension on the web roll (19) is too high, it may be difficult for the printer (14) to pull in the web (18). Conversely, if the back tension is too low, the web (18) may not be properly aligned and the web (18) may slip as it is being pulled in by the printer (14). In general, it is anticipated that the tension of the web roll (19) should be kept within a range of about 500 grams to about 1200 grams; however, these ranges are not intended to limit the scope of the invention. The tension of the web roll (19) will naturally increase as the web (18) is pulled into the printer. Accordingly, in some embodiments, it is contemplated that an automatic tension control system (not shown), which maintains the back tension on the web (18) at a constant value as it is being pulled in by the printer (14), could be used.

Feeding of Leader Portion of Web Through Fusing Station

Secondly, it important that a leader portion (36) of the continuous web (18) first be fed through the fusing station (38) in the printer (14) as illustrated in FIG. 1 before the printing operation can begin. The fuser rollers (40,42) in the fusing station (38) need to first grab and engage the web (18) before commencing the printing operation. The web (18) must be engaged by the fuser rollers (40, 42) and stabilized, i.e. pulled taught, before the labels (20) can be printed thereon. The feeding of the leader portion (36) of the web (18) through the printer to the fusing station (38) allows the fuser rollers (40, 42) to grab and engage the web (18). The length of the leader portion (36) can vary depending upon the size of the printer (14). In general, the length of the leader portion (36) will exceed the distance measured from the last toner transfer station (86) to the fusing rollers (40, 42) in the fusing station (38). In the embodiment as illustrated, i.e. for the Oki laser printer, the length of the leader portion (36) is typically about 16 inches. In other printers with different print mechanisms and/or arrangement of print stations, the leader portion (36) will have a different length. The web material (18), because it is wound on a roll, has a relatively high degree of curl or curvature along its length. In this invention, the fuser rollers (40, 42) are designed to pull in the web (18) and relax the curl in the web (18). This causes the web (18) to flatten, and the web feeding path through the printer (14) is made generally straight.

In the feeding, printing, and cutting system of the present invention, the fuser rollers (40, 42) in the fusing station (38) operate at a speed slightly faster than the speed of the conveyor belt (44) so that the fuser rollers (40, 42) can pull in the web (18). This unique pulling mechanism helps to eliminate curl in the web (18) and keep the web (18) straight and taut as it is being pulled into the printer (14). This pulling mechanism and the differential speeds of the fuser rollers (40,42) and conveyor belt (44) are described in greater detail below.

In contrast, the transport system and the fuser rollers in a conventional printer (not shown) are designed to operate at the same speed. In other words, if a conventional printer employs a conveyor belt to transport a sheet of paper to a fusing station, the speed of the conveyor belt and fuser rollers are synchronized to run at the same speed. The speeds are synchronized, because operators do not want the fuser rollers to pull too hard or too fast on the paper sheet. These conventional printers are designed to keep the paper sheet in a relaxed state as the sheet is fed from the conveyor belt and through the fusing station.

General Overview of Components in Roll Feeding Unit

Referring back to FIG. 3, one end portion (28) of the roll feeding unit (12) supports the roll of web material (18). The roll feeding unit (12) further includes a roll feeding station generally indicated at (46) located at the other end portion (47) of the frame (24). In general, the continuous web (18) is drawn over a guide roller (48) that is fastened to and extends from one side wall segment (26*a*) to the other side wall segment (26*b*) of the frame (24). The web (18) then passes between an upper feed roller (50) and a lower feed roller (52) and is fed to the printer (14). The upper and lower feed rollers (50, 52) also are fastened to and extend from one side wall segment (26*a*) to the other side wall segment (26*b*). The lower feed roller (52) is powered by a motor drive source. The roll feeding unit (12) also includes a cutter subassembly (16). The feeding of the continuous web (18) from the roll feeding unit (12) to the printer (14); printing of the web (18); and cutting of the web (18) will now be described in more detail.

Feeding of Web Under Sensor I In Printer

Figure 4:
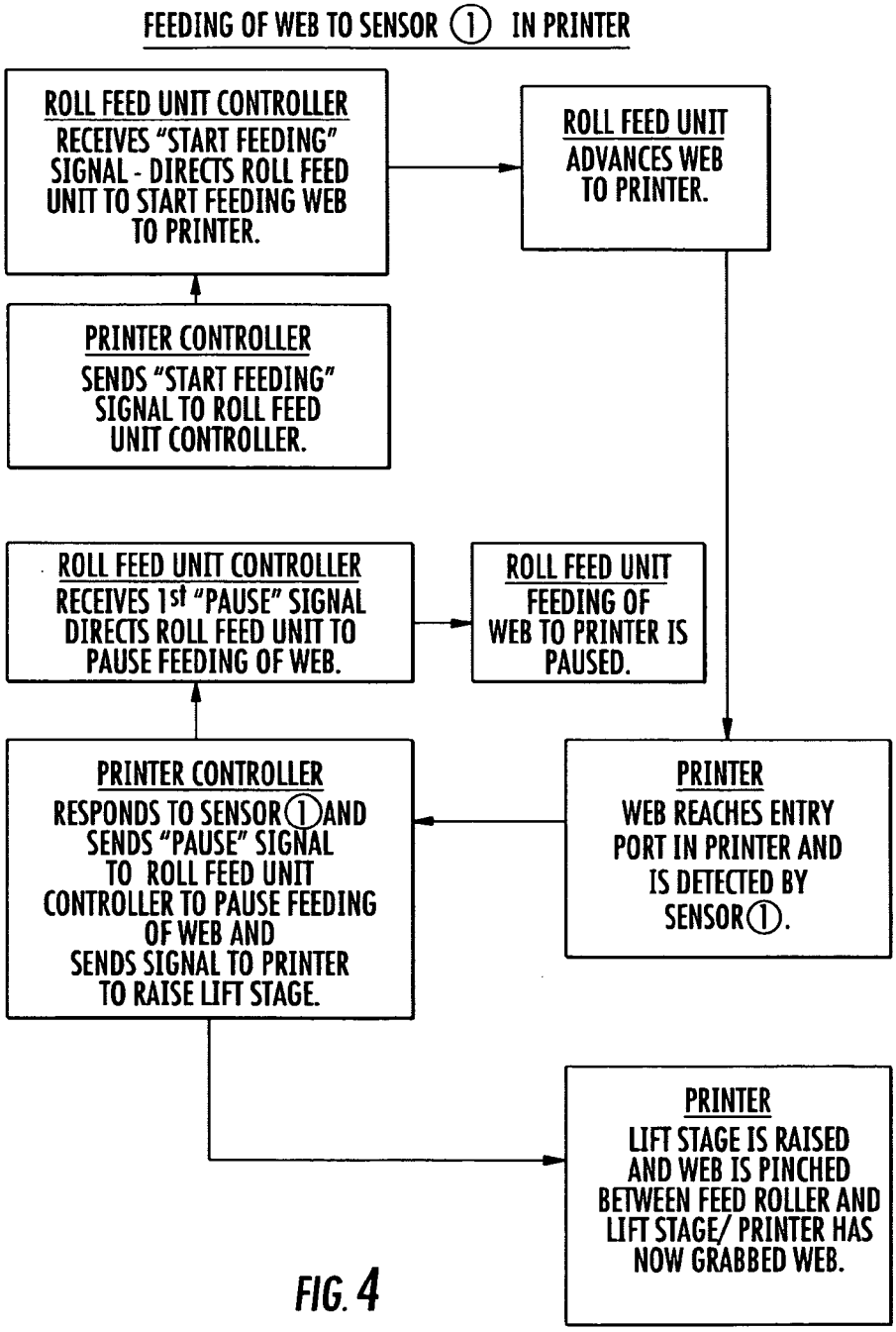
FIG. 4 is a flow chart illustrating the feeding of the web to Sensor 1 in the printer.

Referring to FIG. 4, a flow chart diagramming the feeding of the web (18) from the roll feeding unit (12) to Sensor 1 in the printer (14) is shown. The positions of Sensor 1 and other hardware in the printer (14) are illustrated in FIG. 1.

Generally speaking, the printer controller initially receives a printing command from an associated computer. The printing command includes the necessary information from the computer for the print image, length of the print job, etc. The feeding of the web material (18) is thereafter initiated by the printer controller sending a "START FEEDING" signal to the roll feeding unit controller that then directs the roll feeding unit (12) to begin "pushing" the web (18) downstream towards the printer (14). Referring to FIG. 1, an in-feed station in the printer (14) is generally indicated at (54). A first optical sensor (Sensor 1) is positioned at an entry port (56) of the printer (14) and adjacent to the in-feed station (54). The in-feed station (54) includes an upper feed roller (58) which is powered by a motor drive source and an opposing lower lift stage (60). A registration roller subassembly, generally indicated at (62) and including an upper registration nip roller (64) and a lower registration nip roller (66), is located downstream of the feed roller (58) and lift stage (60). A second optical sensor (Sensor 2) is located between the feed roller (58)/lift stage (60) mechanism and the registration roller sub assembly (62). A third optical sensor (Sensor 3) is located at an exit port (68) of the in-feed station (54).

At the point where the leading edge of the web (18) passes under Sensor 1, the sensor detects this web movement, and provides feedback to the printer controller. The printer controller responds to Sensor 1 and sends a first "PAUSE" signal to the roll feeding unit controller. In turn, the roll feeding unit controller commands the roll feeding unit (12) to temporarily stop feeding the web (18) to the printer (14). This pausing step is important, because it will give the in-feed station (54) sufficient time to grab the web (18) from the roll feeding unit (18). The roll feeding unit (12) is thus in the process of "handing-off" the web (18) to the printer (14).

Then, the printer controller directs the printer (14) to raise the lower lift stage (60) in the in-feed station (54) so that the web (18) can be pinched between the lift stage (60) and the upper feed roller (58). As the lift stage (60) is raised, pressure is exerted against the web (18) and the web (18) is pinched. The raised lift stage (60) and upper feed roller (58) pinch and engage the web (18) securely.

Feeding of Web Under Sensors 2 and 3 in Printer

Figure 5:
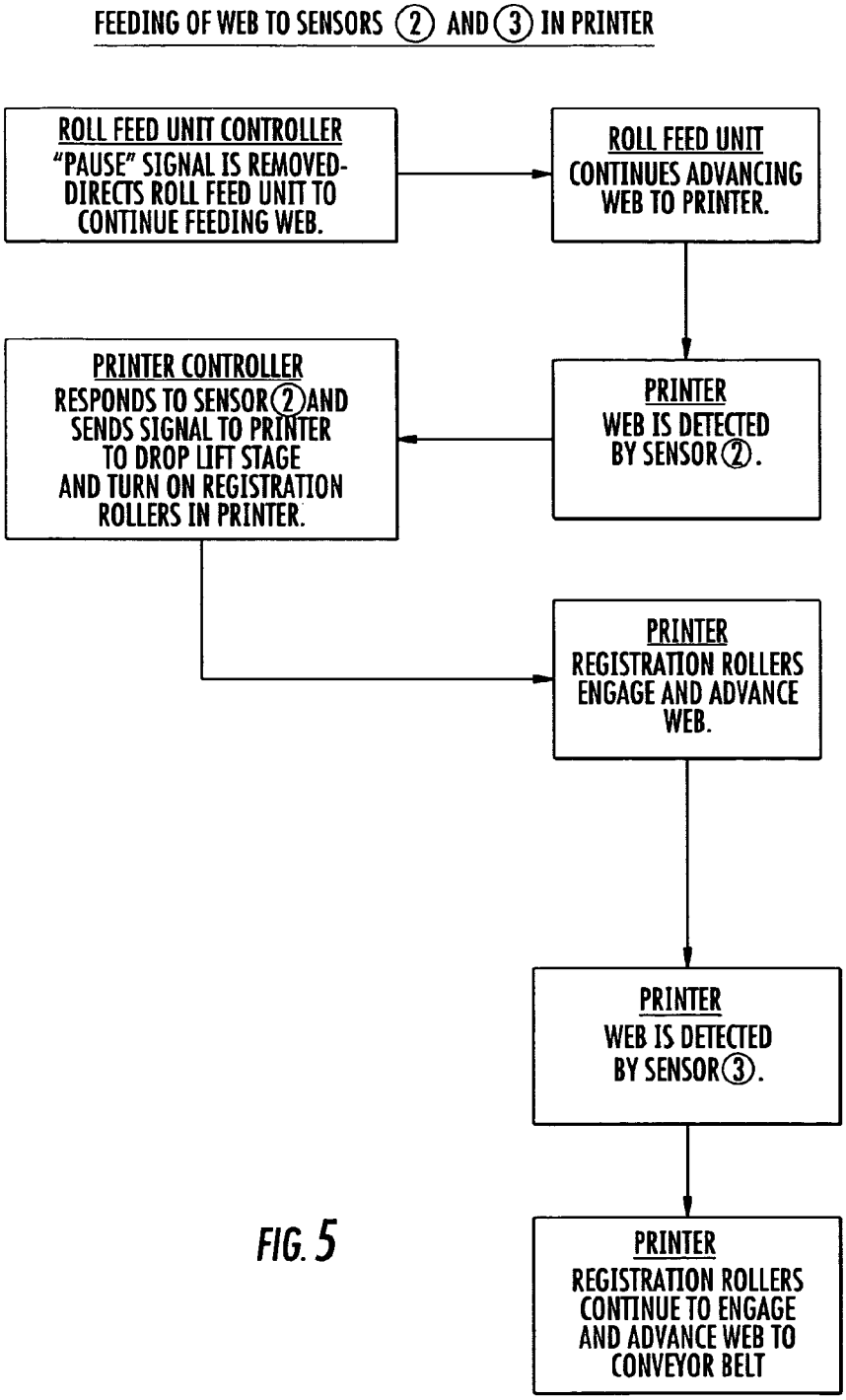
FIG. 5 is a flow chart illustrating the feeding of the web to Sensors 2 and 3 in the printer.

Referring to FIG. 5, a flow chart diagramming the feeding of the web (18) to Sensors 2 and 3 in the printer (14) is shown. The positions of Sensors 2 and 3 are illustrated in FIG. 1.

After the above-mentioned short "PAUSE" signal is turned off by the roll feeding unit controller, the roll feeding unit (12) is directed to continue feeding the web (18) to the printer (14). Then, at the point where the leading edge of the web (18) passes under Sensor 2 in the printer (14), the sensor detects this movement, and provides feedback to the printer controller. The printer controller responds to Sensor 2 and commands the lift stage (60) in the in-feed station (54) to drop. Simultaneously, the printer controller turns on the registration roller subassembly (62) in the printer (14). The registration nip rollers (64, 66) now grab the web (18) and are ready to advance the web (18). The registration roller subassembly (62) has a one-way clutch which is activated so that the nip rollers (64, 66) can engage the web (18) and begin advancing it to the conveyor belt (44) in the printer (14). The conveyor belt (44), in turn, will transport the web (18) to a printing station (70) and the fusing station (38) so that a printed image can be produced on each label (20) carried by the web (18). This printing step is described in detail above.

The fuser rollers (40, 42) are powered by a different motor than the one used to power the conveyor belt (44). Thus, the fuser rollers (40, 42) can operate at a speed faster than the speed of the conveyor belt (44), and this allows the fuser rollers (40, 42) to pull in the web (18) as described in further detail below.

The registration nip rollers (64, 66) advance the web (18) from the in-feed station (54) to the conveyor belt (44). As the web (18) advances, it passes under a third optical sensor (Sensor 3) located at the exit port (68) of the in-feed station (54). Sensor 3 detects the movement of the leading edge of the web (18) at this point and ensures that the web (18) is in position to be transported by the conveyor belt (44) to the printing station (70). The feeding of the web (18) to the printer (14) stops due to the upper and lower feed rollers (50, 52) in the roll feeding unit (12) having engaged the web and completed a single rotation as described in further detail below. Also, at this point, the fusing station (38) continues to warm-up and the print registration is made ready so that the printer (14) can begin printing images on the labels (20).

Now, the roll feeding unit (12) has completed its hand-off of the web (18) to the printer (14), and the printing of the labels (20) can begin. It is important that the handing-off of the web (18) from the roll feeding unit (12) to the printer (14) be properly synchronized as described above. In the feeding and printing system of this invention, the roll feeding unit controller and printer controller effectively communicate with each other to precisely time this hand-off. The operation of the upper and lower feed rollers (50, 52) in the roll feeding unit (12) as they advance the web (18) to the printer (14) now will be described in more detail.

Curved and Flattened Surface Portions of the Feed Rollers in Roll Feeding Unit

Figures 6, 6A:
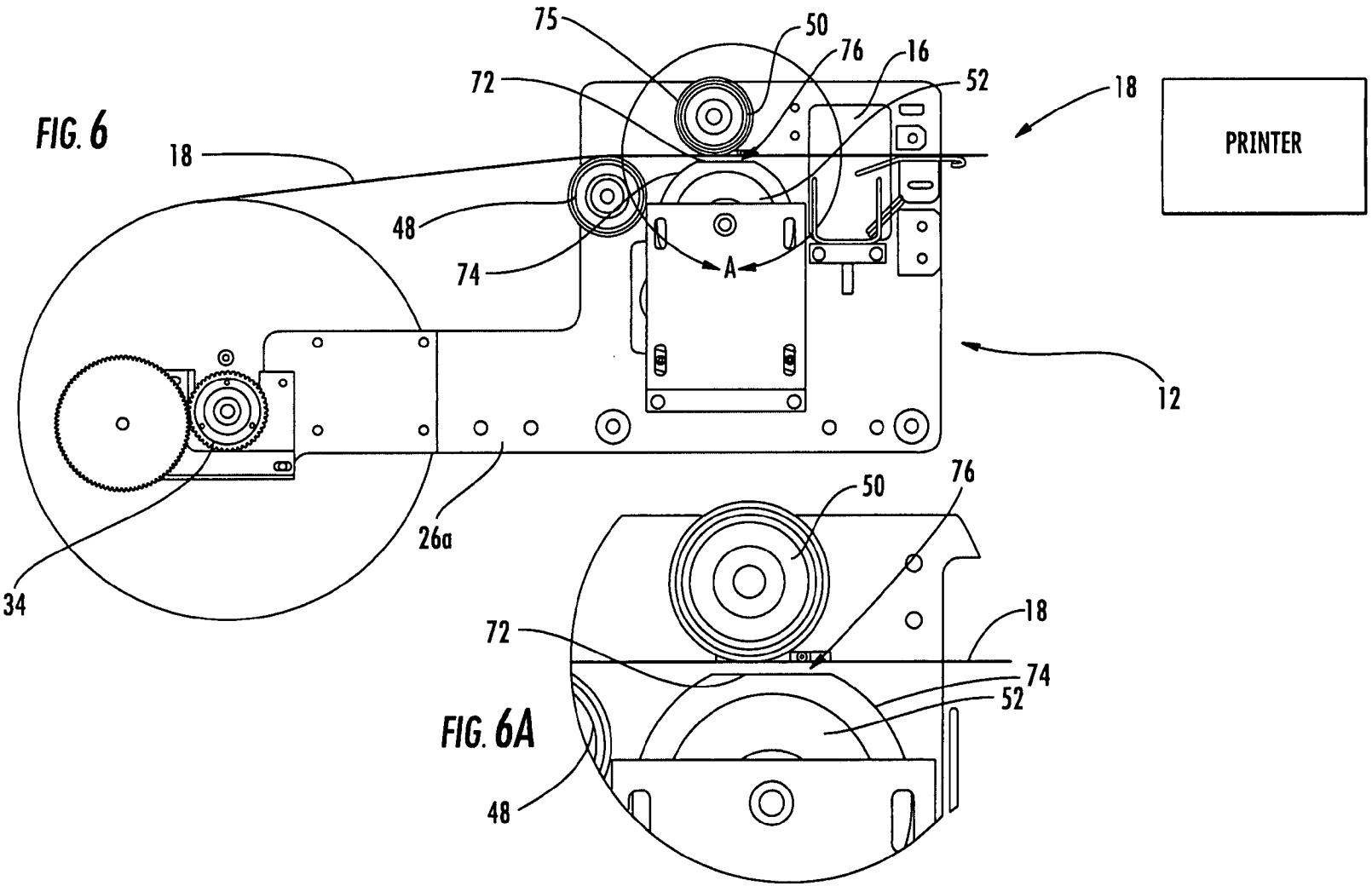
FIG. 6 is a side perspective view of the roll feeding unit in FIG. 3 showing the web at a starting position along the web feeding path to the printer.
FIG. 6A is a close-up view of the upper feed roller and lower feed roller in the roll feeding unit of FIG. 6.

Referring to FIGS. 6 and 6A, the web (18) is shown in a starting position within the roll feeding unit (12). The outer surface of the lower feed roller (52) contains a flattened surface portion (72) and an adjoining curved surface portion (74). In FIGS. 6 and 6A, the flattened surface portion (74) of the lower feed roller (52) is shown adjacent to the outer curved surface (75) of the upper feed roller (50). A gap (76) is created between the lower feed roller (52) and upper feed roller (50) when the feed rollers (50,52) are in this starting position. This gap (76) allows for free movement of the web (18). The upper and lower feed rollers (50, 52) will rotate to advance the web (18) to the printer (14).

Figure 7:
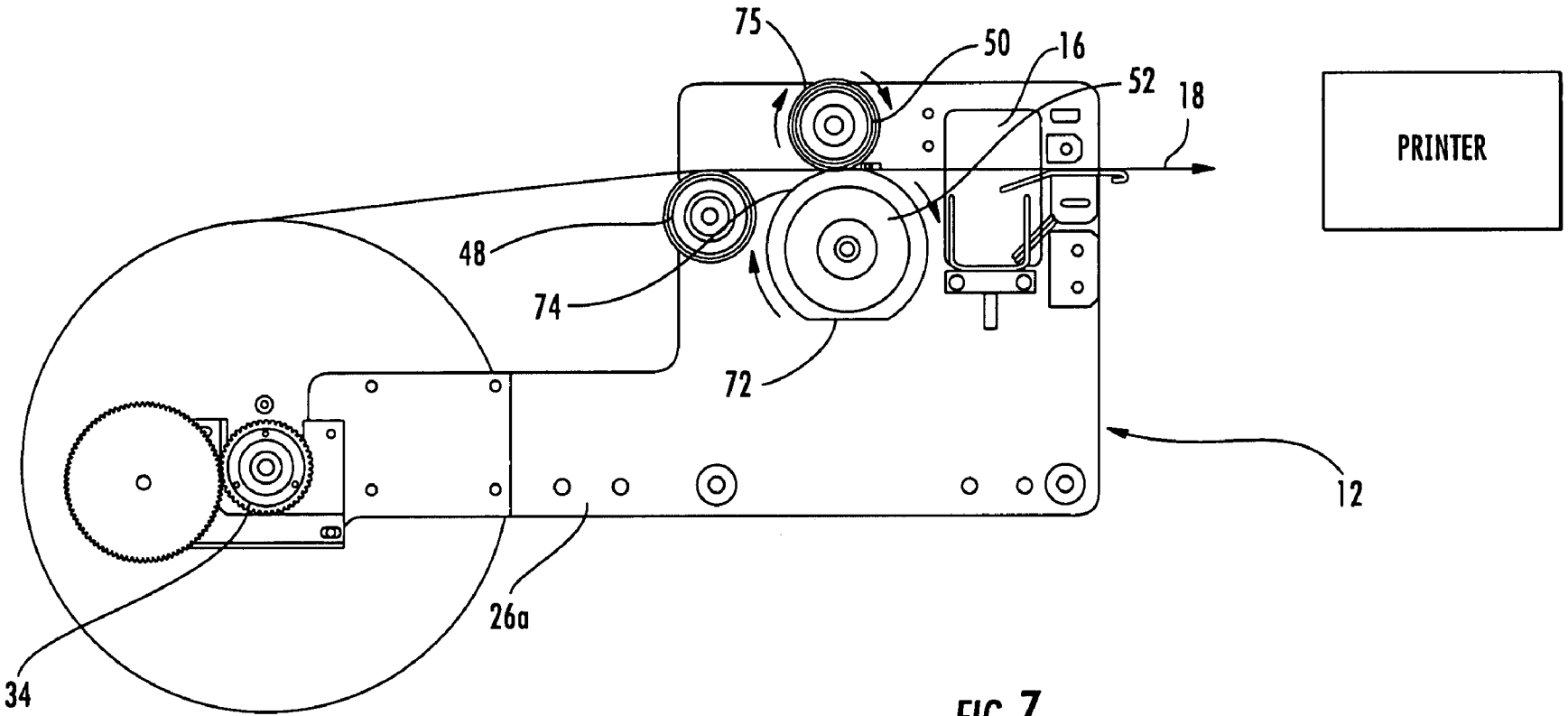
FIG. 7 is a side perspective view of the roll feeding unit in FIG. 3 showing the web at a mid-point position along the web feeding path to the printer, wherein the upper and lower feed rollers of the roll feeding unit have completed one-half (½) of a revolution.

Turning next to FIG. 7, the upper and lower feed rollers (50, 52) are shown as each having rotated to a mid-point position and they are feeding the web (18) downstream towards the printer (14). As the lower feed roller (52) rotates, the curved surface portion (74) of the lower feed roller (52) engages the web (18). As the upper feed roller (50) rotates, its outer curved surface (75) also engages the web (18). This action of the upper and lower feed rollers (50, 52) exerts pressure against the web (18). In this manner, the upper and lower feed rollers (50, 52) engage and advance the web (18) along a web feeding path to the printer (14).

Figure 8:
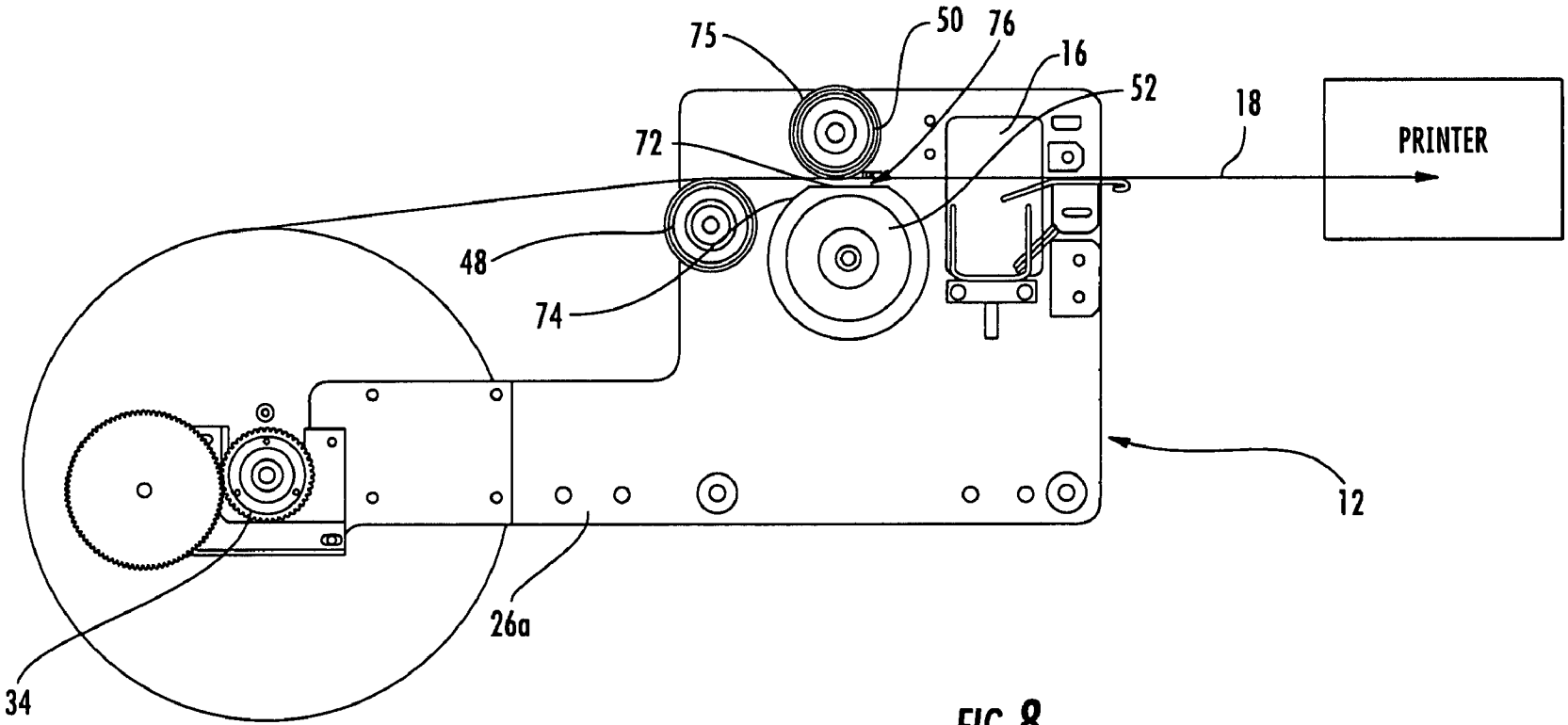
FIG. 8 is a side perspective view of the roll feeding unit in FIG. 3 showing the web at an entry position to the printer, wherein the upper and lower feed rollers of the roll feeding unit have completed a full revolution.

In FIG. 8, the upper and lower feed rollers (50, 52) are shown as each having completed a single, full rotation. Thus, the flattened surface portion (72) of the lower feed roller (52) is again adjacent to the outer curved surface (75) of the upper feed roller (50). The web (18) now has been fed to the registration roller subassembly (62) in the printer (14). (The grabbing of the leading edge of the web (18) by the registration rollers (64, 66) in the printer (14) is described in detail above.) The roll feeding unit (12) has completed its hand-off of the web (18) to the printer (14), and the individual labels (20), which are being carried by the web (18), can now be printed thereon. The web (18) will be transported through the printer (14) by the conveyor belt (44) and the labels (20) will be printed thereon by the above-described toner transfer process.

In this embodiment, the roll feeding unit (12) continuously feeds the web material (18) and the leading edge of the web (18) is advanced downstream, until the upper and lower feed rollers (50, 52) have completed a full rotation. As described above, the upper and lower feed rollers (50, 52) advance the web (18) along a web path and into the printer (14), wherein the registration roller subassembly (62) grabs onto the web (18). The distance of the web path from the upper and lower feed rollers (50, 52) to the registration roller subassembly (62) closely approximates the circumference dimensions of the lower feed roller (52). In other words, if the circumference of the lower feed roller (52), as measured along its curved surface portion (74) only, excluding the flattened surface portion (72), is about 5 inches, the leading edge of the web (18) travels a distance of about 5 inches as the upper and lower feed rollers (50, 52) complete a single rotation.

The roll feeding unit (12) thus feeds the web (18) continuously and the leading edge of the web (18) is advanced downstream, until the flat surface portion (72) of the lower feed roller (52) rotates into alignment with the upper roller (50). As the flat surface portion (72) of the lower feed roller (52) aligns with the upper roller (50), a gap (76) is formed between the upper and lower feed rollers (50, 52), and the web (18) is no longer engaged within the nip. The feeding of the web (18) to the printer (14) stops at this disengagement point.

Feeding of the Web Through the Fusing Station in the Printer

Figure 9:
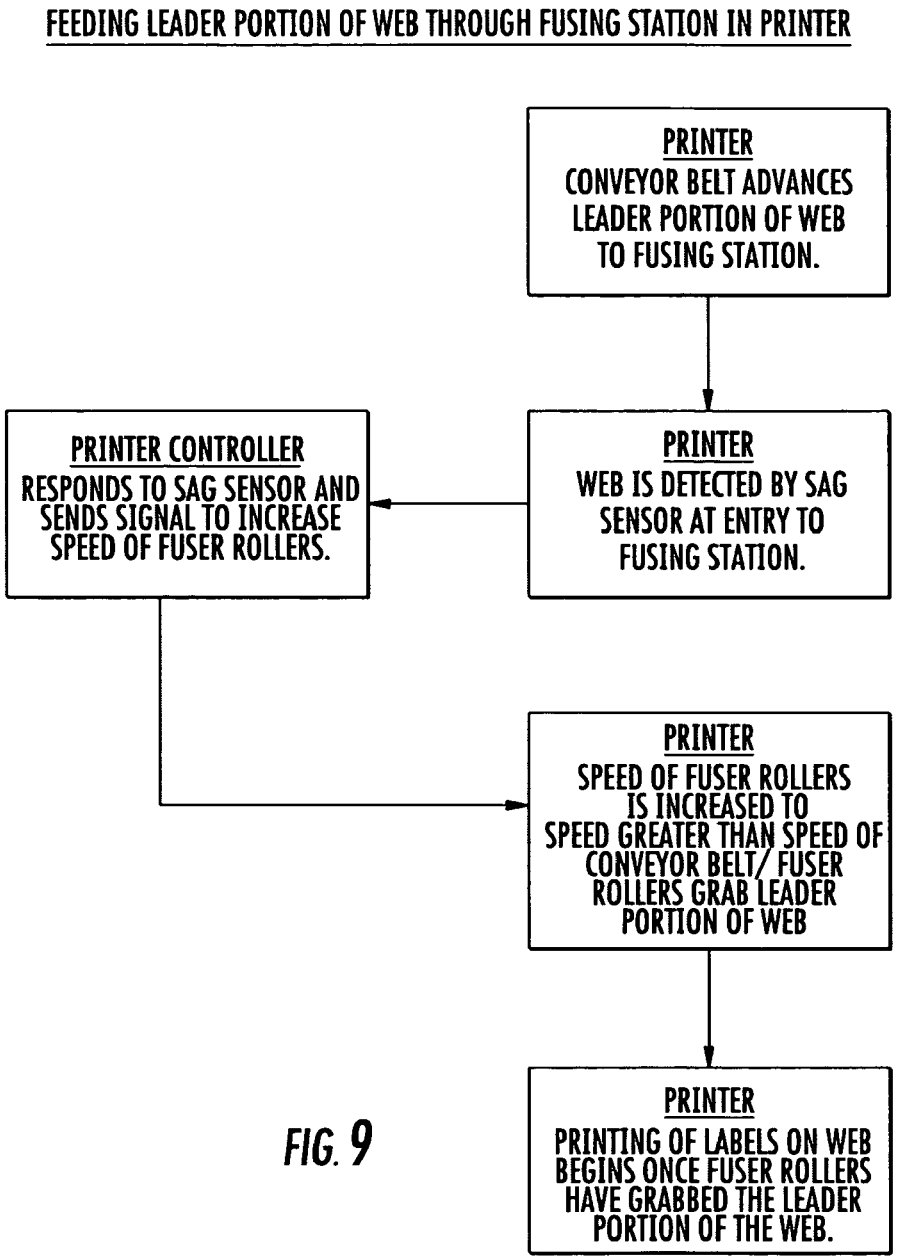
FIG. 9 is a flow chart illustrating the feeding of the leader portion of the web through the fusing station in the printer.

Referring to FIG. 9, a flow chart diagramming the feeding of the leader portion (36) of the web (18) through the fusing station (38) in the printer (14) is shown. The hardware of the fusing station (38) is illustrated in FIG. 1.

The conveyor belt (44) advances a leader portion (36) of the web (18) to the fusing station (38) that includes a Sag Sensor. The Sag Sensor is located upstream of the fuser rollers (40, 42) in the fusing station (38). The Sag Sensor can detect curl or curvature in the web (18) as the web is being fed into the fusing station (38). The printer controller responds to this feedback from the Sag Sensor and sends a signal to the printer (14) to increase the speed of the fuser rollers (40, 42) so that they can pull in the web (18), thereby eliminating any curl and curvature in the web (18). The fuser rollers (40, 42) in the fusing station (38) are powered by a separate motor than the motor used to power the conveyor belt (44). This allows the fuser rollers (40, 42) to run at a different speed than the speed of the conveyor belt (44).

In other words, the speed of the fuser rollers (40, 42) can be adjusted independently of the speed of the conveyor belt (44). In the system of the present invention, the speed of the fuser rollers (40, 42) is adjusted to a speed slightly greater than the speed of the conveyor belt (44). Preferably, the speed of the fuser rollers (40, 42) is adjusted so that the fuser rollers run at a speed in the range of about 0.5 to about 1.0% faster than the speed of the conveyor belt (44), and more preferably at a speed of about 0.8% faster than the speed of the conveyor belt (44). With the fusing rollers (40, 42) and conveyor belt (44) operating at slightly different speeds, the fusing rollers (40, 42) can engage and pull in the web (18) firmly, thereby making the web (18) straight and taut. The fuser rollers (40,42) eliminate the curl or curvature in the web (18) by tightly gripping and pulling in the web (18). The fuser rollers (40, 42) also exert heat and a slight amount of pressure to fix or fuse the printed toner image on the labels (20) being carried by the web (18). As the web (18) exits the fusing station (18), the web (18) is detected by an Exit Sensor mounted on the printer (14). The Exit Sensor detects the movement of the leading edge of the web (18) at this point. The printer controller responds to the feedback from the Exit Sensor and sends a signal to the printer (14) to start the printing cycle.

Different Modes of Operation

Media Priming

Figure 10:
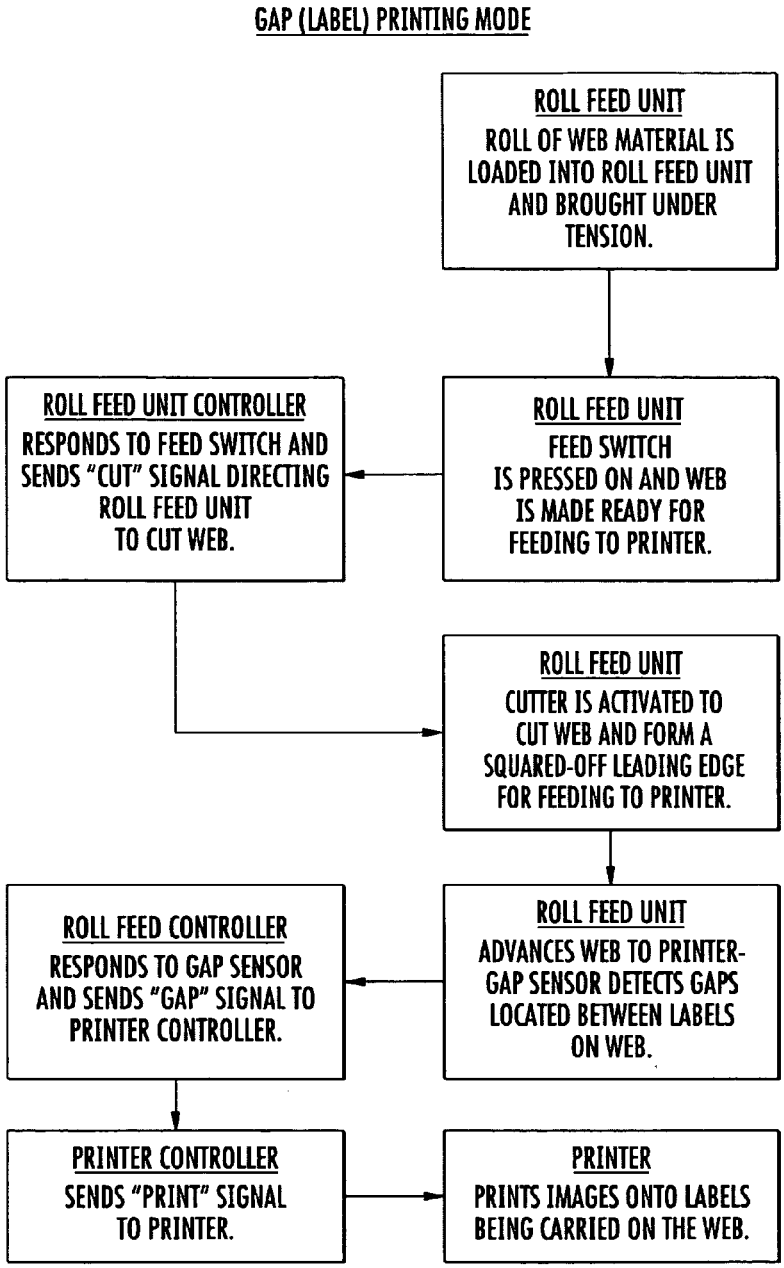
FIG. 10 is a flow chart illustrating the printing of the labels on the web in a gap (label) printing mode.

Before any printing can be accomplished using the apparatus, the print media (18) must be loaded in the assembly and "primed", i.e. made ready for feeding into the printer (14). As shown in FIG. 10, the roll of web material (18) is first loaded into the roll feeding unit (12) and brought under tension. A feed or prime switch (not shown), which is mounted on the roll feeding unit (12), is pressed on. The roll feeding unit (12) then begins advancing the web (18) to an initial web feeding position. The web (18) is being made ready for feeding into the printer (14).

Figure 11:
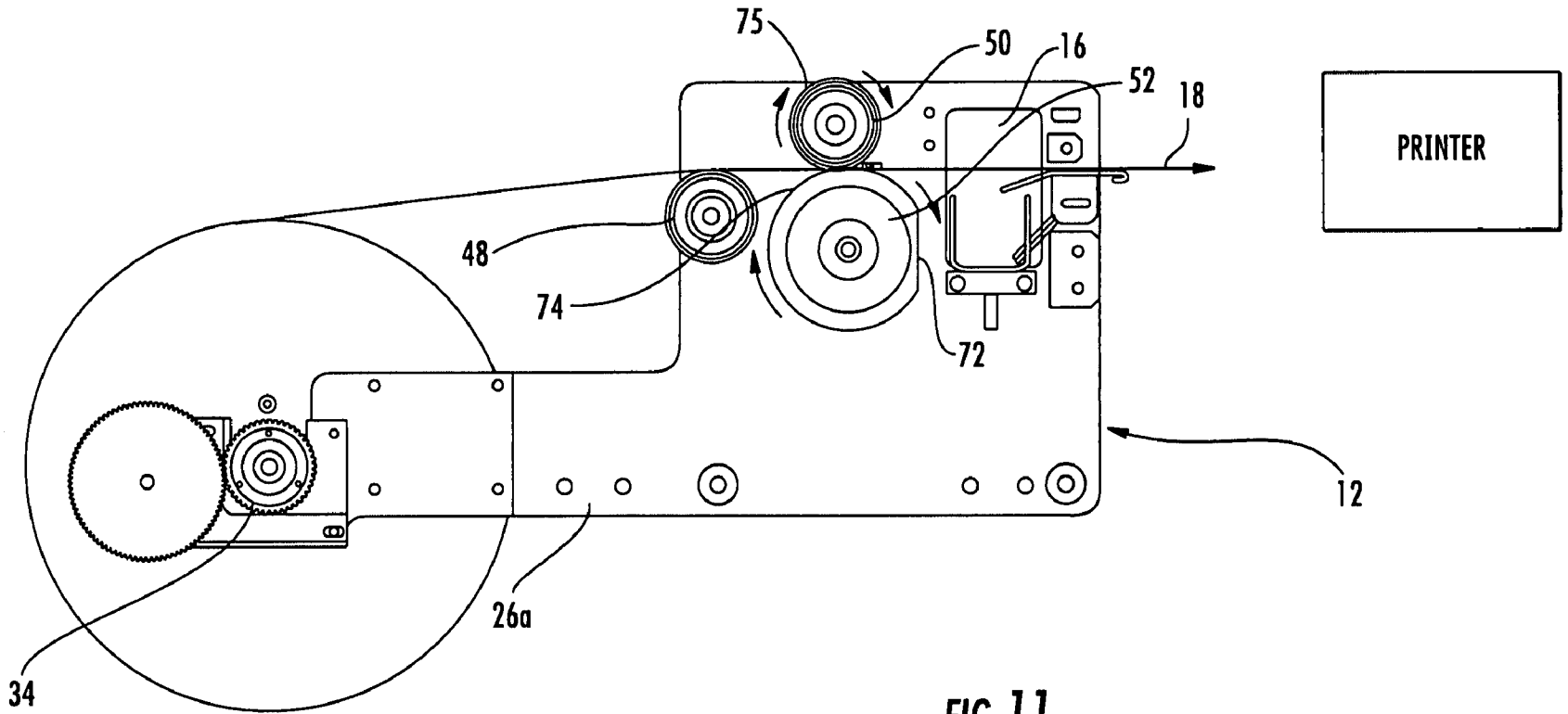
FIG. 11 is a is a side perspective view of the roll feeding unit in FIG. 3 showing the lower feed roller in a rotated position so that it makes contact with and pinches the web prior to the cutting of the web.

As the web (18) advances past the Gap Sensor, the roll feeding unit controller responds to the Gap Sensor and commands the roll feeding unit (12) to "CUT" the web (18). The roll feeding unit (12) receives the "CUT" signal and the stepper feeding motor of the roll feeding unit (12) is first activated. This causes the lower feed roller (52) to rotate until the curved surface portion (74) of the roller (52) makes contact with and pinches the web (18). The lower feed roller (52) only needs to rotate a relatively small degree to contact and pinch the web (18) in this pre-cutting step of the operation. In FIG. 11, the lower feed roller (52) is shown grabbing and pinching the web (18). The lower feed roller (52) is shown in a one-quarter rotated position in FIG. 11 for illustration purposes only. It should be recognized that the lower feed roller (52) will grab and pinch the web (18) before it makes a one-quarter rotation. This pinching of the web (18) by the feed rollers (50, 52) secures the web (18) in place and prevents the web (18) from back-slipping. The web (18) is held firmly in place by the feed rollers (50, 52) so that its leading edge can be cut accordingly.

The cutter (16) in the roll feeding unit (12) then is activated to cut the web (18) precisely and squarely. In this manner, the leading edge of the web (18) is cut and squared-off so that it is ready to be fed to the printer (14). In the case of printing labels or other adhesive-backed materials, it is important that the cut-line on the web (18) be made at some distance away from the edge of a given label (20). If the cut is made very near or at the edge of the label (20), a small edge portion or sliver of label (20) may be left remaining on the web (18), and this piece of label (20) may disengage from the backing during feeding and may cause feeding and printing problems. Preferably, the cut-line is made at the center of a given label (20).

Gap Mode Printing

In the printing of labels (20) or other items such as cards, tags, tickets, receipts, coupons, and the like, which are separated by gaps (22) at predetermined distances along the length of the web (18), or which require aligned printing, i.e. perforated stock, the feeding and printing system of this invention can be operated in a gap or label printing mode. The flowchart in FIG. 10 illustrates this gap or label printing mode.

As the roll feeding unit (12) feeds the web (18) to the printer (14), the Gap Sensor mounted on the roll feeding unit (12) detects the presence of the gaps (22) located between the individual labels (20) on the web (18) and provides this feedback to the roll feeding unit controller. The Gap Sensor can operate by emitting light which passes through the semi-transparent backing of the web (18) when gaps (22) between the labels pass over the Gap Sensor. The roll feeding unit controller responds to the Gap Sensor signals and sends a "GAP" signal to the printer controller. The printer controller receives the feedback from the Exit Sensor as the leading edge of the web (18) moves past the Exit Sensor as described above. Then, the printer controller acknowledges the "GAP" signal and commands the printer (14) to register a print on the label (20). The toner transfer and label printing processes are described in detail above.

Reflective Registration Mode Printing

It is also recognized that the feeding and printing system of this invention can be set to operate in a reflective registration mode. In a reflective registration mode, the continuous roll of web material (18) contains registration marks. For example, the roll of web material (18) can be paper card stock containing registration marks, i.e. black lines or notches, located at predetermined positions along the length of the web (18). A Reflective Sensor, which is mounted on the roll feeding unit (12), detects the registration marks on the web material (18) and provides this feedback to the roll feeding unit controller. The Reflective Sensor can operate by emitting light which is reflected back to the sensor when it strikes a reflective portion of the web material (18) or emitting light which passes through the notches. The roll feeding unit controller responds to the Reflective Sensor by sending a signal to the printer controller. The printer controller then directs the printer (14) to print the image on the imaging surface of the web material (18). In this manner, a printed image is registered properly on the imaging surface of the web (18) as the web (18) is fed through the printer (14).

Continuous Printing Mode

In another embodiment, the feeding and printing system is set to operate in a continuous printing mode. In a continuous printing mode, neither a Gap Sensor nor a Reflective Sensor is utilized since there are no gaps or registration marks. Rather, the printer (14) prints images on the web (18) continuously. The web (18) is advanced so that a given label (20) to be printed thereon converges with an imaging element in the printer (14) at the proper time and a printed image is registered on the label (20).

Encoder Wheel

In another alternative embodiment, an encoder wheel is mounted on the drive roller (52) of the roll feeding unit (12), or on one of the guide rollers (48), and is used to detect the number of revolutions made by the roller (48) and thus the linear distance that the web (18) has been advanced. The raw distance data is provided to the roll feeding unit controller to calculate when the web (18) has advanced the required distance. Thus, the encoder wheel acts as a web motion sensor and is used to detect when the end of the web material (18) has been reached.

Normal Cutting Operation

The feeding station (46) of the roll feeding unit (12) further includes a cutter device (16) for severing the web (18) at a predetermined position. In FIG. 3, the cutter device (16) is shown as being in the form of a rotating cylindrical arm (92) with a blade (94) attached thereto. The cutter device (16) is powered by a motor drive source. Other cutter devices (16) also can be used in accordance with this invention. For example, a knife-like, guillotine cutter device (16) can be used.

Figure 12:
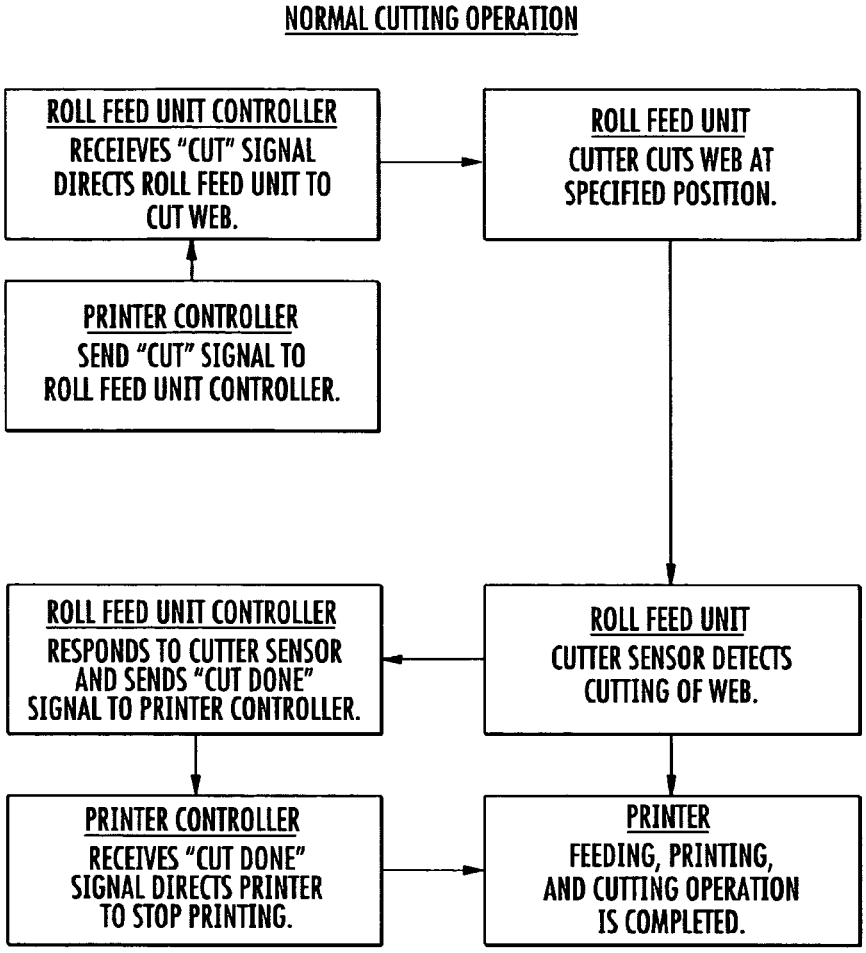
FIG. 12 is a flow chart illustrating the cutting of the web by a cutter in the roll feeding unit in accordance with a normal cutting operation.

A flow chart in FIG. 12 illustrates the cutting of the web (18) during a normal cutting operation. At the end of a normal printing job, the printer controller sends a "CUT" signal to the roll feeding unit controller. The roll feeding unit (12) receives the "CUT" signal and the stepper feeding motor of the roll feeding unit (12) is first activated. As discussed above, this causes the lower feed roller (52) to rotate until the curved surface portion (74) of the roller (52) makes contact with and pinches the web (18). Referring back to FIG. 11, the lower feed roller (52) is shown in a one-quarter (¼) rotated position and its curved surface portion (74) has contacted and pinched the web (18). This pinching of the web (18) by the feed rollers (50, 52) secures the web (18) in place and prevents the web (18) from back-slipping. Then, the cutter (16) is activated to sever the web (18). The web (18) is cut precisely and squarely at this point.

The Cutter Sensor, which is mounted to the roll feeding unit (12), detects that the web (18) has been cut. The roll feeding unit controller responds to this feedback from the Cutter Sensor and sends a "CUT DONE" signal to the printer controller. The printer controller receives the "CUT DONE" signal from the printer controller and commands the printer (14) to stop printing. The feeding, printing, and cutting of the web (18) now has been completed.

Figure 13:
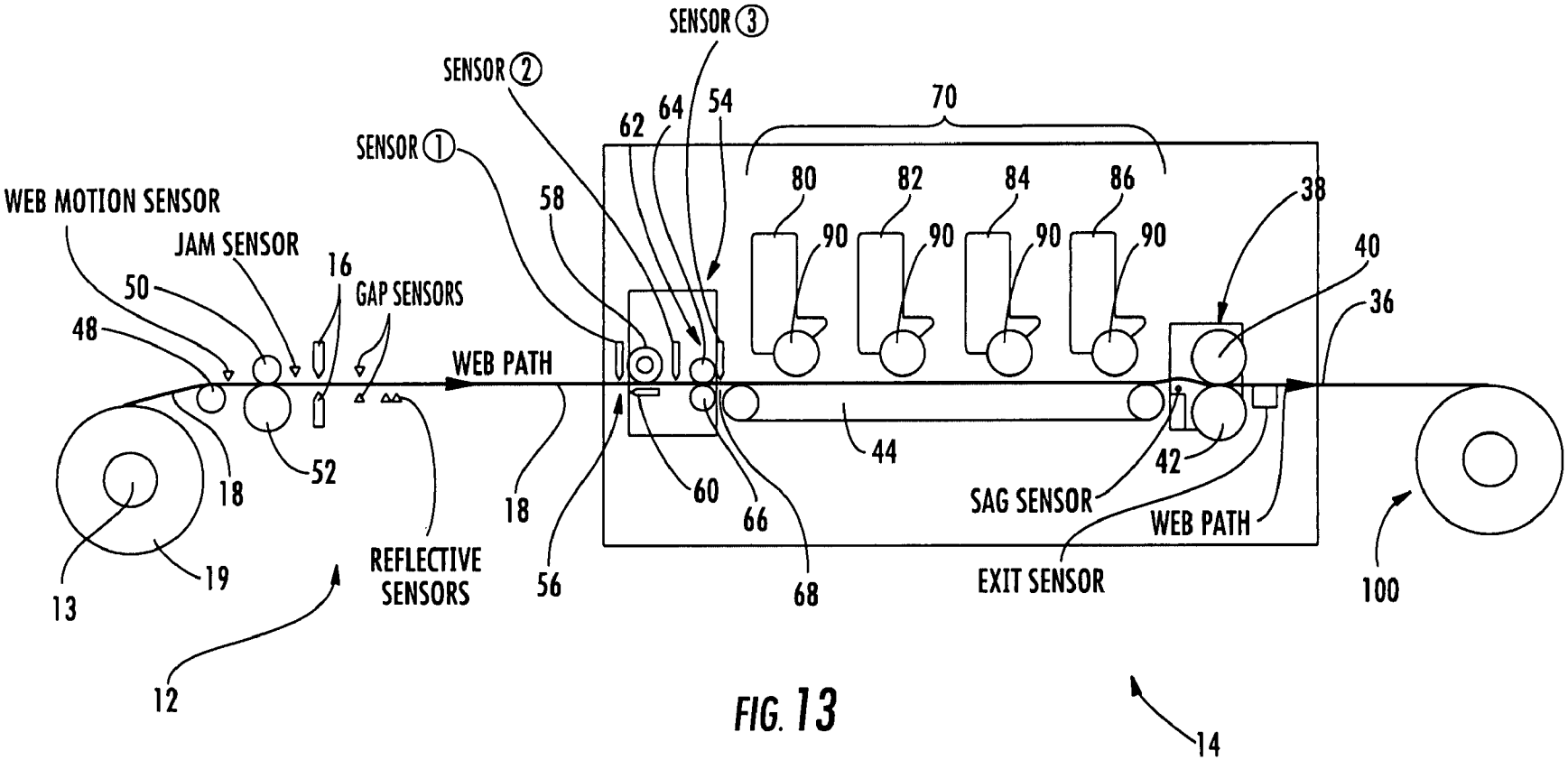
FIG. 13 is a flow chart illustrating the feeding of the web from the roll feeding unit through the printer and including the winding-up of the printed web by a take-up spool.

The web (18) carrying the printed labels (20) is then discharged from the printer (14) and can be wound onto a take-up spool (100) as shown in FIG. 13. The finished roll of printed adhesive labels (20) is now ready to be applied to packages, containers, or other articles.

The cutting of the continuous web (18) in this manner forms a new leading edge for the web (18). In the next printing operation, this new leading edge of the web (18) will be fed from the roll feeding unit (12) to the printer (14) and the labels (20) being carried by this new portion of the web (18) will be printed thereon per the mechanism described above.

Cutting Operation Because of Error

Figure 14:
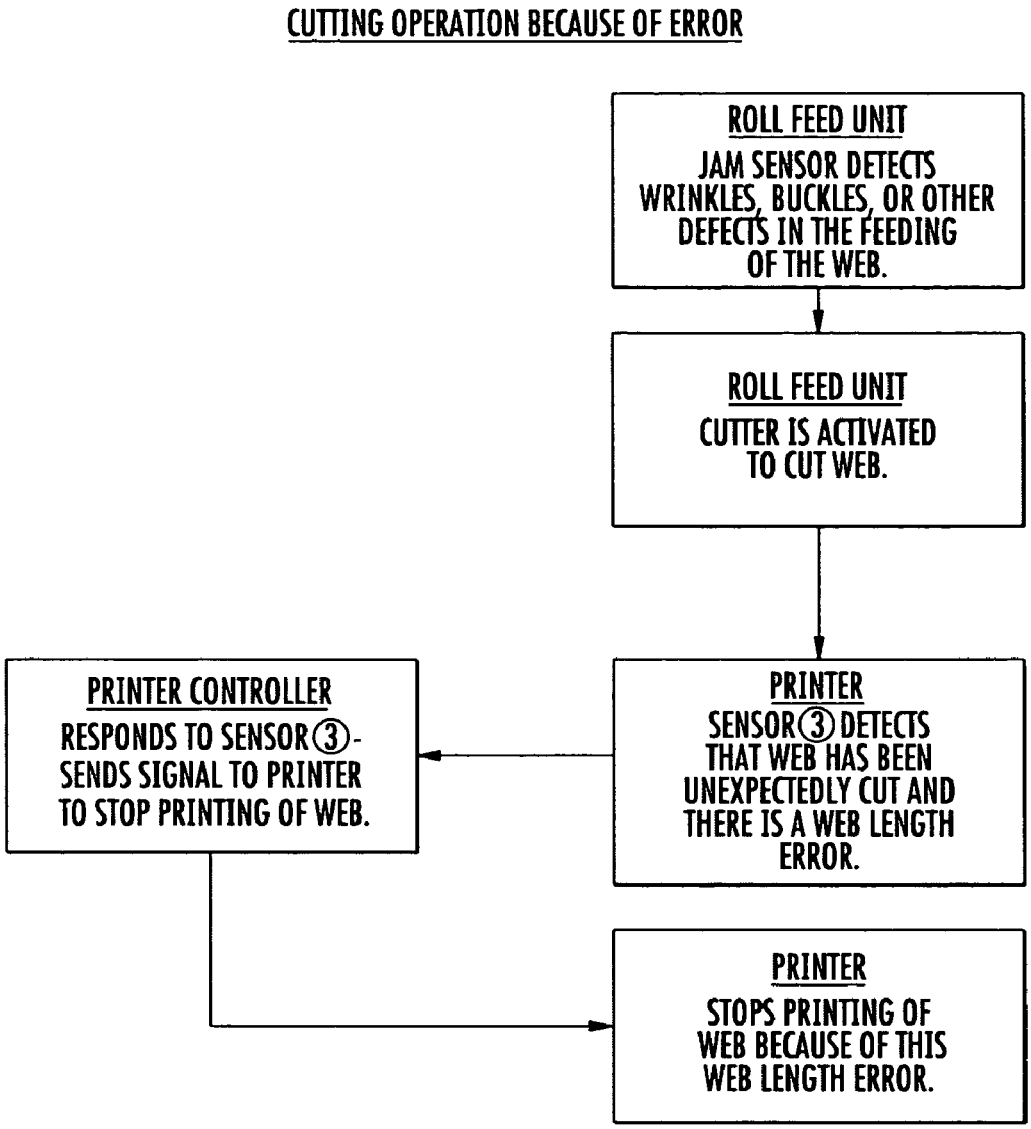
FIG. 14 is a flow chart illustrating the cutting of the web by the cutter in the roll feeding unit because of an error.

A flow chart in FIG. 14 illustrates the cutting of the web (18) during a cutting operation that occurs because of an error in the feeding or printing of the web (18). The roll feeding unit (12) includes a Jam Sensor which can detect jams, wrinkles, buckles, and other defects in the feeding of the web (18) to the printer (14). The roll feeding unit controller responds to this feedback from the Jam Sensor and commands the roll feeding unit (12) to CUT the web immediately. Sensor 3 in the printer (14) detects that the web (18) has been cut unexpectedly and that there is a web length error. Then, the printer controller responds to the web length error detected by Sensor 3 and commands the printer (14) to STOP printing of the web. The printing operation stops and errors out at this point. It is important that the Jam Sensor detect any such jamming or other feeding problems and that the web (18) is cut immediately and the printer errors out, because the feeding of a defective web to the printer (14) can severely damage the printer (14). Particularly, the pressure-sensitive adhesive labels (20) on jammed webs (18) may become detached from the web (18). Once the adhesive material becomes exposed, it may stick to the photosensitive drums (90) or other components in the printer (14). It is very difficult to remove the adhesive material from these printer components, and these components can be permanently ruined.

Cutting Operation When the End of the Roll is Detected by Web Motion Sensor

Figure 15:
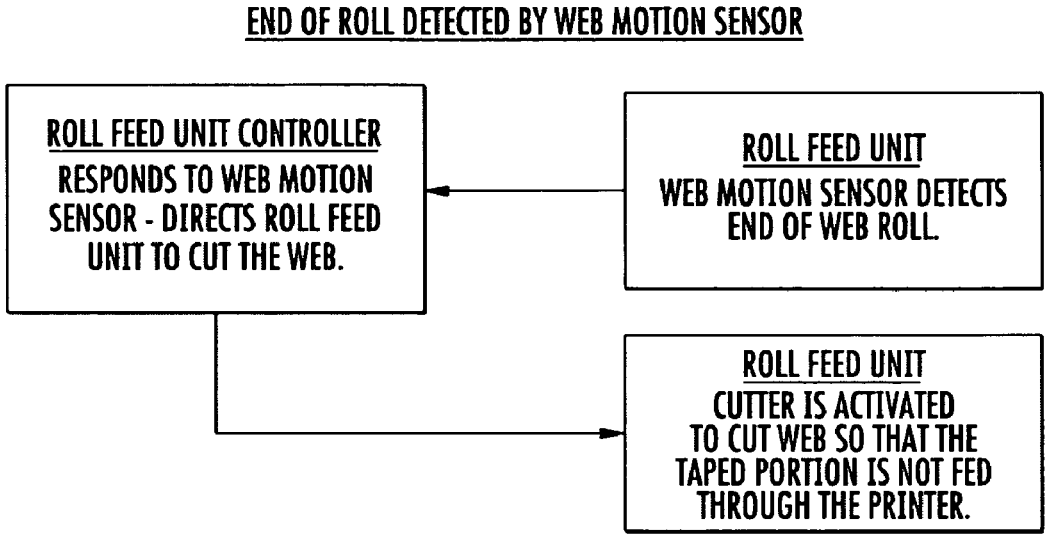
FIG. 15 is a flow chart illustrating the cutting of the web by the cutter in the roll feeding unit after the end of the web roll has been reached.

A flow chart in FIG. 15 illustrates the cutting of the web (18) when the end of the web roll (19) is detected by a Web Motion (End of Web) Sensor. Typically, the end edge of the web (18) is attached to the core (13) of the roll (19) by a strip of adhesive tape. To prevent the strip of tape from being advanced through the printer (14), the roll feeding unit (12) includes a End of Web Sensor which detects the end of the web roll (19). The encoder wheel can act as the End of Web Sensor as discussed above. In alternative embodiments, an optical sensor device can be installed and used as the End of Web Sensor. The roll feeding unit controller responds to the signal from the End of Web Sensor and directs the roll feeding unit to CUT the web (18) immediately. In this manner, the taped portion located at the end of the web (18) is not fed into the printer (14).

Once printing is completed, the web (18) carrying the printed labels (20) is then discharged from the printer (14) and can be wound onto a take-up spool as shown in FIG. 13. Then, a new roll of web material (18) carrying labels (20) to be printed thereon may be loaded in the roll feeding unit (12), and a new feeding, printing, and cutting cycle can begin.

Communication Between Roll Feeding Unit Controller And Printer Controller

Figure 16:
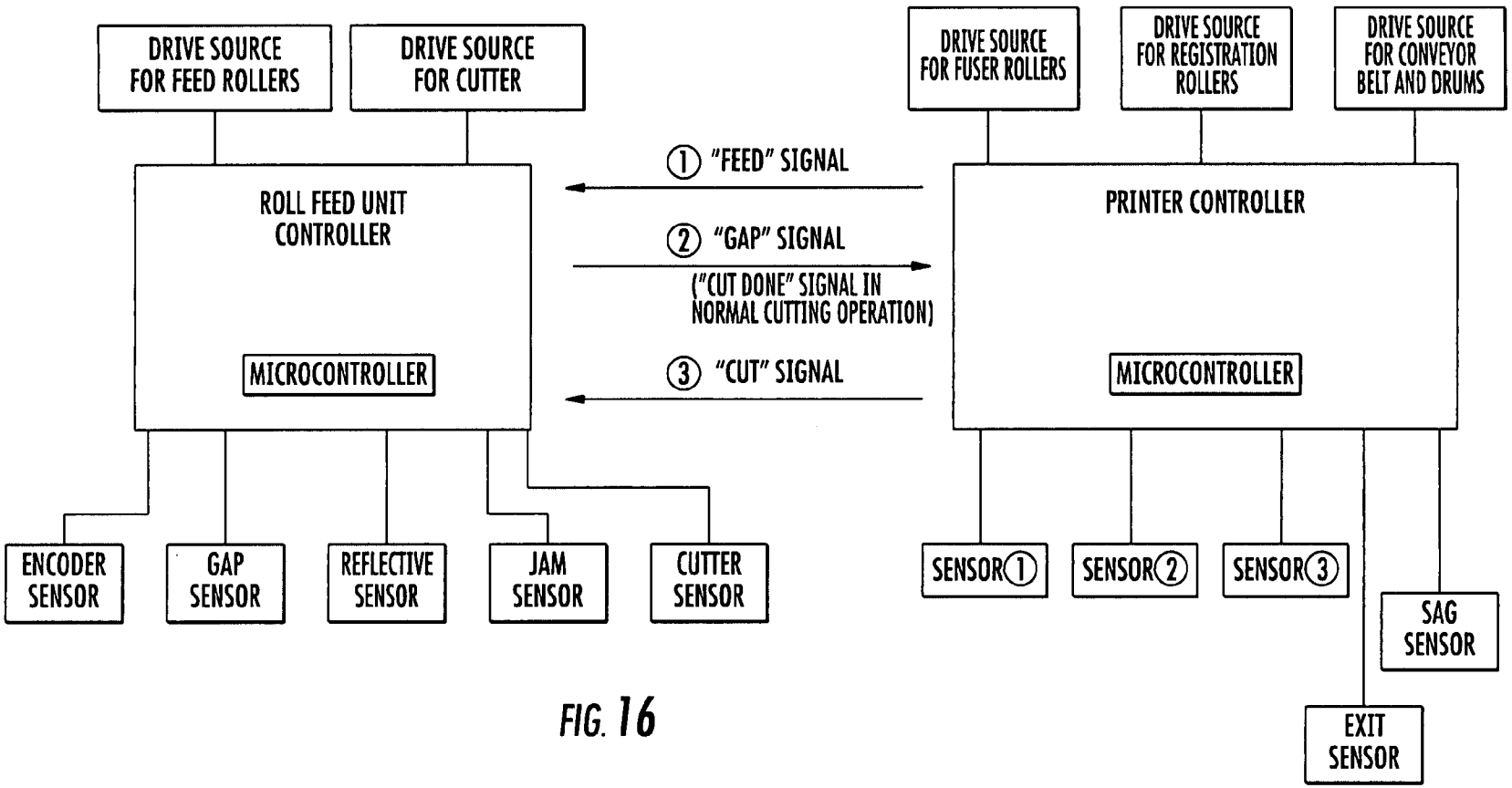
FIG. 16 is a block diagram showing the control systems of the roll feed unit and printer.

Referring to the block diagram in FIG. 16, the communication pathways between the roll feeding unit controller and the printer controller are shown. As described above, the printer controller basically sends two key signals to the roll feeding unit controller. First, the printer controller sends a "START FEEDING" signal to the roll feeding unit controller to initiate the feeding of the continuous web (18) to the printer (14). The roll feeding unit controller responds and directs the roll feeding unit to begin pushing the web (18) downstream towards the printer (14). Secondly, at the end of a normal printing job, the printer controller sends a "CUT" signal to the roll feeding unit controller. In turn, the roll feeding unit controller activates the cutter (16) in the roll feeding unit (12) to sever the web (18) at a predetermined position.

Also, as described above, the roll feeding unit controller essentially sends two key signals to the printer controller. First, as the web (18) is fed to the printer (14), a Gap Sensor on the roll feeding unit (12) detects the gaps (22) located between the individual labels (20) on the web (18). The roll feeding unit controller responds to the Gap Sensor and sends a "GAP" signal to the printer controller. The printer controller then commands the printer (14) to register a print on a given label (20). Secondly, after the web (18) has been cut in a normal cutting operation, the Cutter Sensor in the roll feeding unit (12) detects that the web (18) has been cut. The roll feeding unit controller responds to the Cutter Sensor and sends a "CUT DONE" signal to the printer controller. This "CUT DONE" signal, which is sent by the roll feeding unit controller, can be a pulsed energized "GAP" signal.

With this two-way communication system, the roll feeding unit controller and printer controller are able to precisely synchronize the feeding, printing, and cutting operations. This system can be used to produce high-quality printed media such as pressure-sensitive labels, cards, tags, tickets, receipts, coupons, and the like which are carried by the web. In other embodiments, high-quality images can be printed on the plain web material itself.

It is important to note that the signals obtained from the print controller are obtained from output sources already provided by the print controller and that the sensors did not have to be specifically designed or included in the printer for integration with the roll feed unit. The signals obtained are signals normally used by the printer controller for other print operations and are simply tapped from the printer controller for concurrent use by the roll feed controller. Generally speaking, only a few minor changes to the software programming on the printer controller and tapping of the sensor signals are required to integrate the roll feed unit with the printer (14).

Physical Alignment

Figure 17:
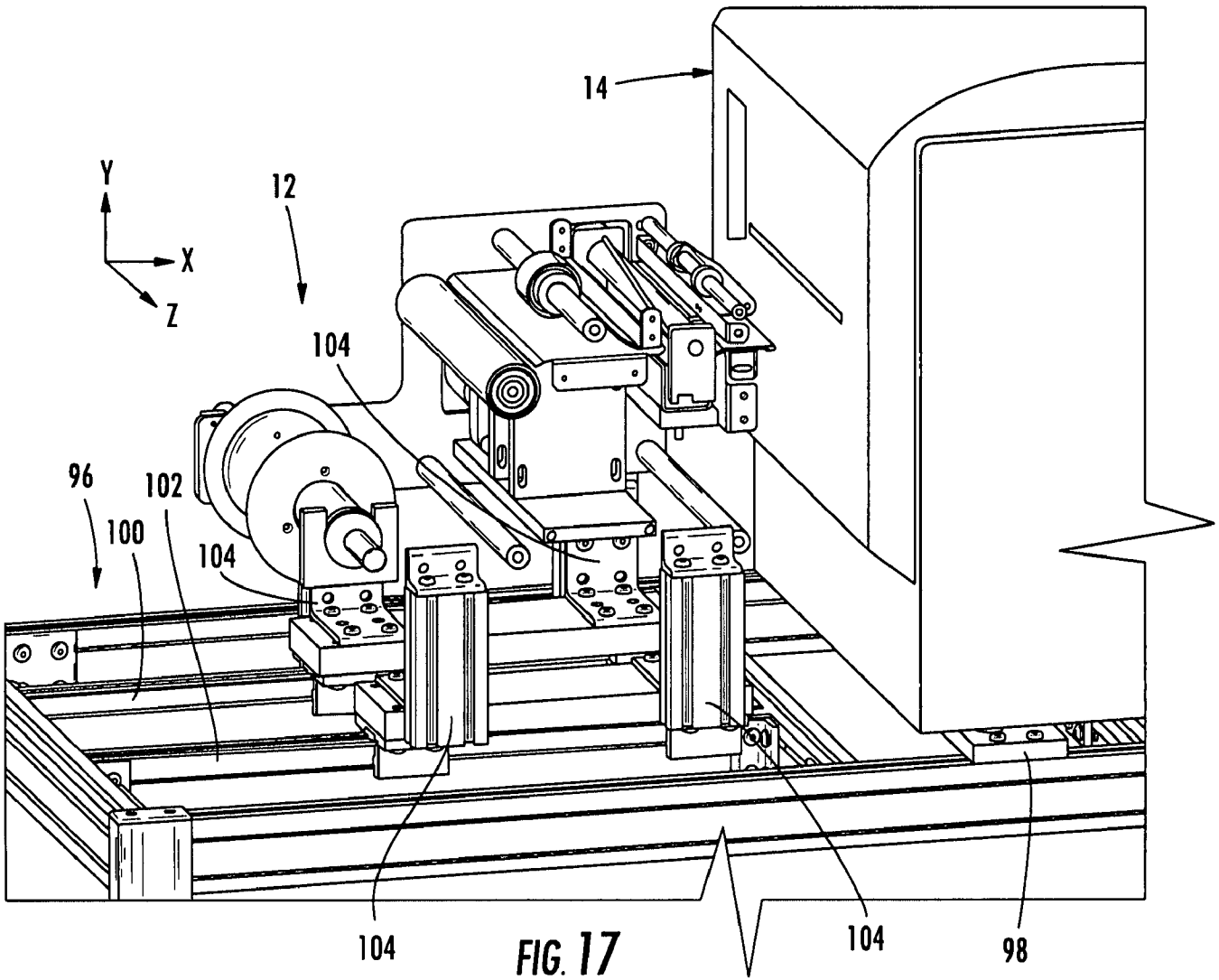
FIG. 17 is a perspective view of the roll feed unit and printer mounted on an alignment frame.

Turning now to FIG. 17, one final important aspect to the invention in the context of providing the roll feed unit (12) as an external retrofit is physical alignment of the roll feed unit (12) with the printer (14). In this regard, the invention further provides an alignment frame generally indicated at (96) onto which the printer (14) and the roll feed unit (12) are mounted. Generally, the alignment frame (96) fixes the relative positions of the printer (14) and the roll feed unit (12) so that the print media (18) tracks accurately through the printer (14). In this regard, the alignment frame (96) provides fixed mounting brackets (98) (only one shown) for securing the printer (14) in all three X, Y Z axes relative to the frame (96). The alignment frame further provides for movement of the roll feed unit (12) along the X-axis with spaced tracks (100, 102) and corresponding slidable mounting brackets (104). Movement of the roll feed unit (12) along the tracks (100, 103) allows the operator access to the printer in feed station (54), to more easily load the roll media (18) into the unit (12) and to more quickly clear paper from the cutter area adjacent to the printer (14). The alignment frame still further includes a locking mechanism (not shown) to releasably secure the roll feed unit (12) in either an operating position wherein the roll feed unit (12) is adjacent to the printer (14) as seen in FIG. 17, or a loading/clearing position (not shown) wherein the roll feed unit (12) is away from the printer (12). There is also a Y-axis alignment (not shown) for the front and back portions of the printer (14) so that the side-to-side position of the printer (14) can be aligned properly.

It is appreciated by those skilled in the art that various changes and modifications can be made to the illustrated embodiments and description herein without departing from the spirit of the present invention. All such changes and modifications are intended to be covered by the appended claims.

What is claimed is:

1. A roll feeding unit for feeding a continuous web of print media from a roll to a sheet fed printer, said sheet fed printer including a printer controller, said roll feeding unit comprising:

(i) a frame having opposing sidewall segments and a first end portion and second end portion, the first end portion including an elongated arm extending from one sidewall segment to the other sidewall segment for supporting a core which holds the continuous roll of print media;

(ii) a feeding station located at the second end portion of the frame for feeding the print media to a printer, the feeding station including upper and lower feed rollers for feeding the print media therebetween;

(iii) a cutter device for cutting the print media; and (iv) at least one sensor for sensing the position of the print media as the print media is fed to the printer;

(v) a roll feeding unit controller for controlling the operations of the roll feeding unit, the roll feeding unit controller being communication with said printer controller whereby the roll feed is synchronized with the printer and a given area of the web is fed to the printer directly from said continuous roll of print media at a rate and in a quantity require by the printer when the printer is ready to print an image on said given area of the web; and (vi) an alignment frame for receiving said printer and said roll feeding unit and aligning said printer and said roll feeding unit relative to each other.

2. The roll feeding unit of claim 1, wherein the feeding unit includes a cutter sensor, and wherein if the cutter sensor detects that the web has been cut, the printer is directed to stop printing on the web.

3. The roll feeding unit of claim 1, wherein the feeding unit includes a jam sensor,and wherein if the jam sensor detects a defect in the feeding of the web to the printer, the feeding unit cuts the web.

4. The roll feeding unit of claim 1, wherein the feeding unit includes a web motion sensor, and wherein if the web motion sensor detects an end of the roll of web material, the feeding unit is directed to cut the web.

5. A printing device for printing on a continuous web of print media, comprising:

a roll feeding unit including:

(i) a frame having opposing sidewall segments and a first end portion and second end portion, the first end portion including an elongated arm extending from one sidewall segment to the other sidewall segment for supporting a core which holds the continuous roll of print media;

(ii) a feeding station located at the second end portion of the frame for feeding the print media to a printer, the feeding station including upper and lower feed rollers for feeding the print media therebetween;

(iii) a cutter device for cutting the print media; and (iv) at least one sensor for sensing the position of the print media as the print media is fed to the printer;

a printer unit for receiving and printing an image on the print media, the printer unit including:

(i) at least one toner transfer station for producing a toner image on the print media as the print media is advanced through the toner transfer station; and (ii) at least one sensor for sensing the position of the print media as it is advanced through the printer;

a roll feeding unit controller for controlling operations of the roll feeding unit;

a printer controller for controlling operations of the printer unit, and an alignment frame for receiving said printer unit and said roll feeding unit and alignment frame printer unit and roll feeding unit relative to each other, the roll feeding unit controller being in communication with said printer controller and being responsive to signals received from the printer controller, and the printer controller being responsive to the sensors of the printer unit and signals received from the roll feeding unit controller so that the feeding, printing, and cutting of the continuous web of print media are controlled and a given area of the print media is advanced directly from said continuous roll of print media to the at least one toner transfer station in the printer rate and in a quantity required by the printer when the toner transfer station is ready to print the image on that area of the print media.

6. The assembly of claim 5, wherein the printer includes a sensor located at an entry port of the printer and adjacent to the in-feed tray station, wherein if the sensor detects the web, the roll feeding unit is directed to pause feeding the web and the printer is directed to raise the lift stage so that the web can be pinched between the lift stage and upper feed roller in the in-feed tray station.

7. The assembly of claim 5, wherein the printer includes a sensor located in the in-feed tray station, wherein if the sensor detects the web, the printer is directed to drop the lower lift stage so that an upper registration roller and lower registration roller can engage the web.

8. The assembly of claim 5, wherein the printer includes a sensor located at an exit port of the in-feed tray station, wherein if the sensor detects the web, the roll feeding unit is directed to pause feeding the web.

9. The assembly of claim 5, wherein the printer further includes: (iii) a fusing station having upper and lower fuser rollers, and (iv) a conveyor belt for advancing the web through the at least one toner transfer station and to the fusing station, whereupon the upper and lower fuser rollers in the fusing station engage the web and fuse the toner image onto the web.

10. The assembly of claim 9, wherein the printer includes a sag sensor located at an entry port of the fusing station, wherein if the sag sensor detects a sag in the web, the upper and lower fuser rollers are directed to run at a speed faster than the speed of the conveyor belt, thereby pulling in the web and making the web straight.

11. The assembly of claim 10, wherein the upper and lower fuser rollers operate at a speed faster than the speed of the conveyor belt.

12. The assembly of claim 11, wherein the upper and lower fuser rollers operate at a speed in the range of about 0.5 to about 1.0% faster than the speed of the conveyor belt.

13. The assembly of claim 5, wherein the roll feeding unit includes a cutter sensor,and wherein if the cutter sensor detects that the web has been cut, the printer is directed to stop printing on the web.

14. The assembly of claim 5, wherein the roll feeding unit includes a jam sensor, and wherein if the jam sensor detects a defect in the feeding of the web to the printer, the roll feeding unit is directed to cut the web.

15. The assembly of claim 5, wherein the roll feeding unit includes a web motion sensor, and wherein if the web motion sensor detects an end of the roll of web material, the roll feeding unit is directed to cut the web.

16. A feed unit for feeding a continuous web of print media to a sheet fed printer, a print station for printing an image on said print media, a print media advancing station for pulling said print media through said print station, and a print controller configured and arrange for controlling operation of said print media advancing station, said feed unit comprising:

a continuous web of print media capable of receiving a print image;

a print media advancing station configured and arranged for advancing said print media to said printer;

a feed unit controller configured and arranged for controlling the operation of the print media advancing station, said feed unit controller being in operative two-way communication with said print controller for sending at least one control signal to said print controller and for receiving at least one control signal from said print controller, said feed unit controller being responsive to said at least one control signal from said print controller, and an alignment frame for receiving said printer and said feed unit and aligning said printer and said feed unit relative to each other, wherein operation of said print media advancing station is synchronized with said print media advancing station and a given area of print media is fed to said print station at a rate and in a quantity required by the print station when the print controller is ready to print an image on said given area of print media such that is said print station can continuously print said image onto said continuous web of print media.

17. The feed unit of claim 16 further comprising a cutting device, said cutting device being responsive to said feed controller for selectively cutting the print media.

18. A printing assembly for printing a continuous web of print media comprising:

a sheet fed printer including a print station for printing an image on said print media, a print media advancing station for pulling said print media through said print station, and a print controller configured and arrange for controlling operation of said print media advancing station and said printing station, a continuous web print media feed unit including a continuous web of print media capable of receiving a print image, a print media advancing station configured and arranged for advancing said print media to said printer, at least one sensor for sensing the position of the print media as the print media is fed to the printer, an alignment frame for receiving said printer and said feed unit and aligning said printer and said feed unit relative to each other, and a feed unit controller configured and arranged for controlling the operation of the print media advancing station, said feed unit controller being in operative two-way communication with said print controller for sending at least one control signal to said print controller and for receiving at least one control signal from said print controller, said feed unit controller being responsive to said at least one control signal from said print controller, wherein operation of said print media advancing station is synchronized with said print media advancing station and a given area of print media is fed to said print station at a rate and in a quantity required by the print station when the print controller is ready to print an image on said given area of print media such that is said print station can continuously print said image onto said continuous web of print media.

19. The printing assembly of claim 18 further comprising a cutting device, said cutting device being responsive to said feed controller for selectively cutting the print media.

* * * * *